US005220379A

United States Patent [19]

Fukuchi et al.

[11] Patent Number: 5,220,379

[45] Date of Patent: Jun. 15, 1993

[54] COLOR IMAGE FORMING APPARATUS

[75] Inventors: Masakazu Fukuchi; Shizuo Morita; Satoshi Haneda; Hisao Satoh; Tadayoshi Ikeda, all of Hachioji, Japan

[73] Assignee: Konica Corporation, Tokyo, Japan

[21] Appl. No.: 734,229

[22] Filed: Jul. 22, 1991

[30] Foreign Application Priority Data

Jul. 26, 1990 [JP] Japan ..... 2-200791
Jul. 26, 1990 [JP] Japan ..... 2-200804

[51] Int. Cl.[5] ..... G03G 15/00

[52] U.S. Cl. ..... 355/200; 355/210; 355/245; 355/260

[58] Field of Search ..... 355/200, 210, 211, 212, 355/260, 208, 209, 203, 245

[56] References Cited

U.S. PATENT DOCUMENTS 5,001,515 3/1991 Nomura et al. ..... 355/200

FOREIGN PATENT DOCUMENTS 57-154255 9/1982 Japan .
57-163276 10/1982 Japan .
58-1161 1/1983 Japan .
58-190961 1/1983 Japan .
58-72159 4/1983 Japan .
58-152263 9/1983 Japan .
58-54392 12/1983 Japan .
59-126568 7/1984 Japan .
59-147366 8/1984 Japan .
59-195673 11/1984 Japan .
60-75850 4/1985 Japan .
60-76766 5/1985 Japan .
60-95456 5/1985 Japan .
60-95458 5/1985 Japan .
0115966 6/1985 Japan ..... 355/260
60-158475 8/1985 Japan .
61-100770 5/1986 Japan .
61-149972 7/1986 Japan .
61-279870 12/1986 Japan .
62-198879 9/1987 Japan .
63-85763 4/1988 Japan .
63-207243 8/1988 Japan .
63-244058 10/1988 Japan .
63-244059 10/1988 Japan .
63-244064 10/1988 Japan .
63-195357 12/1988 Japan .
64-40850 2/1989 Japan .
1-179168 7/1989 Japan .
0309081 12/1989 Japan ..... 355/260
2-8295 2/1990 Japan .
3-55573 3/1991 Japan .

*Primary Examiner*—A. T. Grimley
*Assistant Examiner*—Thu Dang
*Attorney, Agent, or Firm*—Frishauf, Holtz, Goodman & Woodward

[57] ABSTRACT

An image forming apparatus in which a process cartridge contains at least an image carrying member, a developing unit and a developer replenishment unit. The process cartridge can be mounted to or removed from the apparatus for its replacement. The process cartridge can take a first position where images can be formed and a second position where developer can be replenished. The process cartridge can be moved from the first position to the second position when a detector for detecting the depletion of the developer outputs a detection signal.

11 Claims, 22 Drawing Sheets

COLOR IMAGE FORMING APPARATUS

BACKGROUND OF THE INVENTION

The present invention relates to an electrophotographic image forming apparatus for forming an image on a transfer material of a copier or printer.

Many methods and apparatuses for obtaining color images using the electrophotographic method have been proposed. For example, as indicated in Japanese Patent Publication Open to Public Inspection No. 100770/1986, there is a method that latent images are formed on a photosensitive drum, which is an image forming unit, depending on the number of separated colors of an original image, they are transferred onto a transfer drum after being developed so as to form a multi-color image on the transfer drum, and they are then transferred onto a transfer material so as to obtain a color copy. An apparatus using this method requires a transfer drum which is large enough to transfer one sheet of image onto the peripheral surface thereof in addition to the photosensitive drum, and is inevitably large in size and complicated in structure.

Furthermore, for example, as indicated in Japanese Patent Publication Open to Public Inspection No. 149972/1986, there is a method that latent images are formed and developed on a photosensitive drum, depending on the number of separated colors of an original image and they are transferred onto a transfer material when they are developed so as to obtain a multi-color copy. It is difficult in this method to registrate many color images with high accuracy, and good quality color copies cannot be obtained.

Furthermore, there is a method that latent images are formed on a photosensitive drum depending on the number of separated colors of an original image and developed by color toners repeatedly and color toner images are registrated on the photosensitive drum and transferred so as to form a color image. This basic process of multi-color image forming is indicated in Japanese Patent Publication Open to Public Inspection Nos. 75850/1985, 6766/1985, 95456/1985, 95458/1985, and 158475/1985 by the applicant of this patent and others.

In a multi-color image forming apparatus for forming color images by registration like this, a plurality of developing units containing different color toners are installed around the photosensitive drum, and latent images on the photosensitive drum are developed generally by rotating the photosensitive drum several times so as to form color images.

In an image forming apparatus such as a monochromatic color analog copier using the electrophotographic method or a copier or printer using a semiconductor laser LED scanning system, an apparatus has been proposed in which a part of the image forming means is provided as a cartridge unit, for replenishing or replacing various photoconductors of limited durability, developer carriers, cleaning materials, and developer toners when they are exhausted, and the integrated unit of the essential units of these image forming means is removed for maintenance or replacement. Various configurations such that the feed path of a transfer material whereon an image is formed by the image forming means is opened so that the transfer material can be easily removed for clearing a jam have been proposed.

A typical configuration that a photosensitive drum, developing unit, and cleaner are integratedly mounted to a support member so that they can be removed from the main unit and each unit can be easily replaced or repaired is indicated in Japanese Patent Examined Publication No. 54392/1983. A configuration that the essential units of the image forming means are integrated and not reused is indicated in Japanese Patent Publication Open to Public Inspection No. 154255/1982, and a printer configuration that a non-reusable cartridge is used and latent images are formed on a photosensitive drum by dot exposure scanning by a semiconductor laser is indicated in Japanese Patent Publication Open to Public Inspection No. 147366/1984.

Furthermore, the above publications indicate a configuration that the upper frame of the division structure is opened so as to open the transfer material feed path, and the transfer material can be easily removed in case of jamming. Japanese Patent Publication Open to Public Inspection No. 154255/1982 mentioned above indicates a configuration that a non-reusable process cartridge is mounted to the upper frame of the bisecting structure so that it can be replaced, increasing operability of cartridge replacement and the ease of jam clearing. A configuration that priority is given to the ease of process cartridge replacement, such as a replenishment toner cartridge or a collection toner cleaning cartridge, and particularly a process cartridge, is mounted to the lower frame so as to improve the operability of maintenance, is indicated in Japanese Patent Publication Open to Public Inspection No. 1161/1983.

A configuration that a vertical type of the above structure is used so as to improve the same direction operation and jam clearing is indicated in Japanese Patent Publication Open to Public Inspection Nos. 244058/1988, 244059/1988, 244064/1988, and 179168/1989.

However, a compact printer having a process cartridge, which comprises a developing unit and an image carrying member, which can be easily mounted to or removed from the apparatus body, is free of leakage or spilling of toner or developer from the developing unit when it is mounted to or removed from the apparatus body, and free of such problems during clearing of a jammed transfer material, has not been proposed.

A proposal that when the upper frame of a printer of the bisecting structure is open, a process cartridge mounted to the upper frame is always kept horizontal so as to prevent waste toner from spilling is indicated in Japanese Patent publication Open to Public Inspection No. 90961/1983. Although this configuration allows the cartridge to be easily mounted or a jam to be easily cleared, problems such as spilling or leakage of toner when the cartridge is mounted, a jam is cleared, or a replacement operation is performed for maintenance are, has not been solved.

In Japanese Patent Publication Open to Public Inspection No. 72159/1983 that in a printer of the bisecting structure wherein a jam can be easily cleared, a non-reusable cartridge is mounted to the upper frame. In Japanese Patent Publication Open to Public Inspection No. 1161/1983, a replenishment or collection toner can be easily replaced, a process cartridge is mounted on the lower frame, and the process cartridge of a developing unit, cleaning unit, and photosensitive drum is held up for clearing a jam, the operability of process cartridge replacement conflicts with the ease of jam clearing. Furthermore, in these process cartridges, since the developing unit and the cleaning unit are mounted at the bottom across the paper feed path from the transfer pole, toner spills from the developing unit or the cleaning unit even if the process cartridge is surely sealed when the process cartridge is replaced or external vibration or shock is applied to the apparatus body, causing the inside of the apparatus or the transfer paper to become soiled.

The printer indicated in Japanese Patent Publication Open to Public Inspection No. 195357/1988 contains a process cartridge and forms a flat paper feed path at the upper part. However, there are some restrictions on the feed path from the transfer material separation unit of the photosensitive drum to the fixing unit, and problems of the feed unit have not been solved. Furthermore, the printer lacks ease of jam clearing when open, and compactness as a whole due to the upstanding stack paper feed configuration, and the opening angle of the upper frame is restricted. Therefore, the printer is not an apparatus which is superior in operability.

As to a color image forming unit, as described previously, a belt type image forming unit wherein a photoconductor is coated or deposited on a flexible belt has been proposed, for example, in Japanese Patent Application No. 192874/1989 by the applicant of this patent together with a photosensitive drum wherein a photoconductor is coated or deposited on the peripheral surface of the drum. The belt type image forming unit (hereinafter called a photosensitive belt) is determined in shape by stretching between rotating rollers including a drive roller, and is effective in configuring a compact color image forming apparatus using space effectively. Since the photosensitive belt can move along a small curvature, defective separation of a transfer material can be prevented by separating the transfer material using the curvature of a rotating roller with a small diameter.

In a color image forming apparatus using such a photosensitive belt, image forming means such as a charging means, an image exposure means, a plurality of developing units, and a cleaning means are installed mainly below the lower surface of the outer peripheral surface of the photosensitive belt, and those image forming means are integrated in a process cartridge together with the photosensitive belt, and the process cartridge can be freely mounted to or removed from the apparatus body.

A transfer material whereon a color toner image is transferred is ejected onto a paper ejection tray installed on the top of the apparatus with the copy side down. Therefore, the necessary area of a place where the apparatus is to be installed is small.

A configuration that problems of paper feed and jam clearing are solved by using a compact cartridge and same side operation is possible is indicated in Japanese Patent Publication Open to Public Inspection Nos. 40850/1989 and 244059/1988.

A control for outputting an indication when toner of a process cartridge is exhausted or the photoconductor life expires is indicated in Japanese Patent Publication Open to Public Inspection No. 85763/1988. However, an image forming apparatus, which is compact and easy to operate and satisfies all the requirements such as easy jam clearing, no spilling of toner during operation of the cartridge, easy cartridge replacement, and all operations available from one side via the front of the apparatus body, has not been proposed.

Furthermore, the present invention relates to an image forming apparatus for forming a toner image on an image carrying member by the electrophotographic method and transferring the toner image onto a transfer material so as to obtain an image, particularly in an image forming apparatus such as a printer, copier, or facsimile equipment wherein a process cartridge comprising an image carrying member integrated with at least one of a developing means and cleaning means can be freely mounted or removed.

Image forming apparatuses have come into wide use recently according to the needs of the times such as sophisticated information oriented society and individuals. Since there were not so many image forming apparatuses installed earlier, maintenance and management such as exhaustion, degradation, adjustment, and periodic inspection of various members including degradation of an image carrying member and replenishment and disposal of a developer during use of image forming apparatuses were performed by service men. However, as image forming apparatuses have come into wide use, the use status and usage of image forming apparatuses have become diversified, and a very large amount of image forming apparatuses are in use at present. Therefore, it is difficult for service men to perform maintenance and management of image forming apparatuses for users.

For this reason, an image forming apparatus having a process cartridge wherein an image carrying member is integrated with at least one of a developing means and a cleaning means has been developed. In an image forming apparatus having such a process cartridge, for example, a printer or a copier, when the process cartridge life expires due to exhaustion or degradation of an image carrying member in the process cartridge, a developer, or other parts or units, the operator, a general user with no technical knowledge, can easily maintain and manage the image forming apparatus by changing the process cartridge. In an image forming apparatus using such a process cartridge, which is indicated, for example, in Japanese Patent Publication Open to Public Inspection No. 279870/1986, the transfer material mounting direction coincides with the mounting and removing direction of a process cartridge mounted on the upper frame, and hence the operator can stand in front of the apparatus and open the upper frame so as to remove the process cartridge from the upper frame when changing the process cartridge. By doing this, expendable supplies can be easily handled or operated, and restrictions on the operation space can be minimized.

In an image forming apparatus using a process cartridge, when the process cartridge is to be replaced, that is, when the life (durable life, operation life) of the process cartridge expires due to exhaustion or degradation of parts or units in the process cartridge, the operator himself is required to replace it. Therefore, it is necessary to inform the operator of the replacement time. A method for informing an operator of the replacement time of a process cartridge is indicated, for example, in Japanese Patent Publication Open to Public Inspection Nos. 163276/1982 and 152263/1983. In these publications, an image forming apparatus wherein a mechanism for counting the number of revolutions of a photosensitive drum in a process cartridge is mounted and an indication of the process cartridge replacement time is indicated when the count reaches a predetermined number.

However, even when the process cartridge life is detected and indicated by the image forming apparatus indicated in Japanese Patent Publication Open to Public Inspection No. 163276/1982 or 152263/1983, the operator, who sees the indication, is required to open the outer case of the image forming apparatus, pull out the process cartridge from the interior, and replace it. Although the process cartridge life is detected and an indication for it is indicated, the process cartridge is required to be replaced by the operator. Such work is not only extremely troublesome and burdensome but also requires great strength for the operator when the process cartridge is heavy and large due to sophisticated performance and coloration of the image forming apparatus. Furthermore, when pulling out and removing the process cartridge, the operator is required to pass it from one hand to the other, and there is a possibility that the process cartridge is dropped accidentally, some developer scatters, and the operator gets hurt.

SUMMARY OF THE INVENTION

One of the objects of the present invention is to provide an image forming apparatus, in which it is easy to replace expendable supplies, to conduct maintenance, and to clear a jam and, furthermore, to perform each of the above operations from one side of the apparatus.

Another object of the present invention is to provide an image forming apparatus which automatically detects the life of a process cartridge, allows the operator to move or replace the process cartridge whose life has expired by an easy operation, and can be easily maintained, or to provide an image forming apparatus wherein a process cartridge for a color image forming apparatus, which is comparatively heavy, can be replaced in safety and simply when the process cartridge life has expired.

The configuration of an image forming apparatus of the present invention is that in the image forming apparatus wherein a process cartridge containing at least a developing unit and a developer replenishment unit which can be mounted or removed for replacement; the process cartridge has a first position where images can be formed and a second position where a developer can be replenished, and the process cartridge can move from the first position to the second position when a detection means for detecting exhaustion of the developer outputs a detection signal.

Another configuration of an image forming apparatus of the present invention is that in the image forming apparatus wherein a process cartridge containing at least a belt type image carrying member stretched horizontally between two shafts and a plurality of developing units, mounted on the lower periphery of the belt type image carrying member can be inserted so that it can be replaced; the process cartridge has a plurality of developer replenishment units for replenishing a developer to the plurality of developing units, the process cartridge has a first position where images can be formed and a second position where developer can be replenished, and the process cartridge can move from the first position to the second position when a detection means for detecting exhaustion of the developer outputs a detection signal, and at the second position, developer can be replenished to the developer replenishment units or the developer replenishment containers can be replaced.

Another configuration of an image forming apparatus of the present invention is that the image forming apparatus comprises a process cartridge having an image carrying member for forming electrostatic latent images integrated with at least one of a developing means and a cleaning means, which is installed so that it can be mounted or removed freely, a process cartridge moving means for moving the process cartridge from the first position where images can be formed to the second position which is located in the direction reverse to the process cartridge insertion direction, a detection means for detecting the operation life of the process cartridge and outputting a signal, and a control means for controlling the process cartridge moving means according to the signal.

Another configuration of an image forming apparatus of the present invention is that the image forming apparatus comprises a process cartridge having an image carrying member for forming electrostatic latent images integrated with at least one of a developing means and a cleaning means, which is installed so that it can be mounted or removed freely, a process cartridge moving means for moving the process cartridge from the first position where images can be formed to the second position which is located in the direction reverse to the process cartridge insertion direction, a counting means for counting the number of images formed using the process cartridge, and a control means for controlling the process cartridge moving means when the image forming count reaches a predetermined number.

DESCRIPTION OF THE PREFERRED EMBODIMENTS

An embodiment of an image forming apparatus of the present invention is shown in FIGS. 1 to 12.

Figure 1:
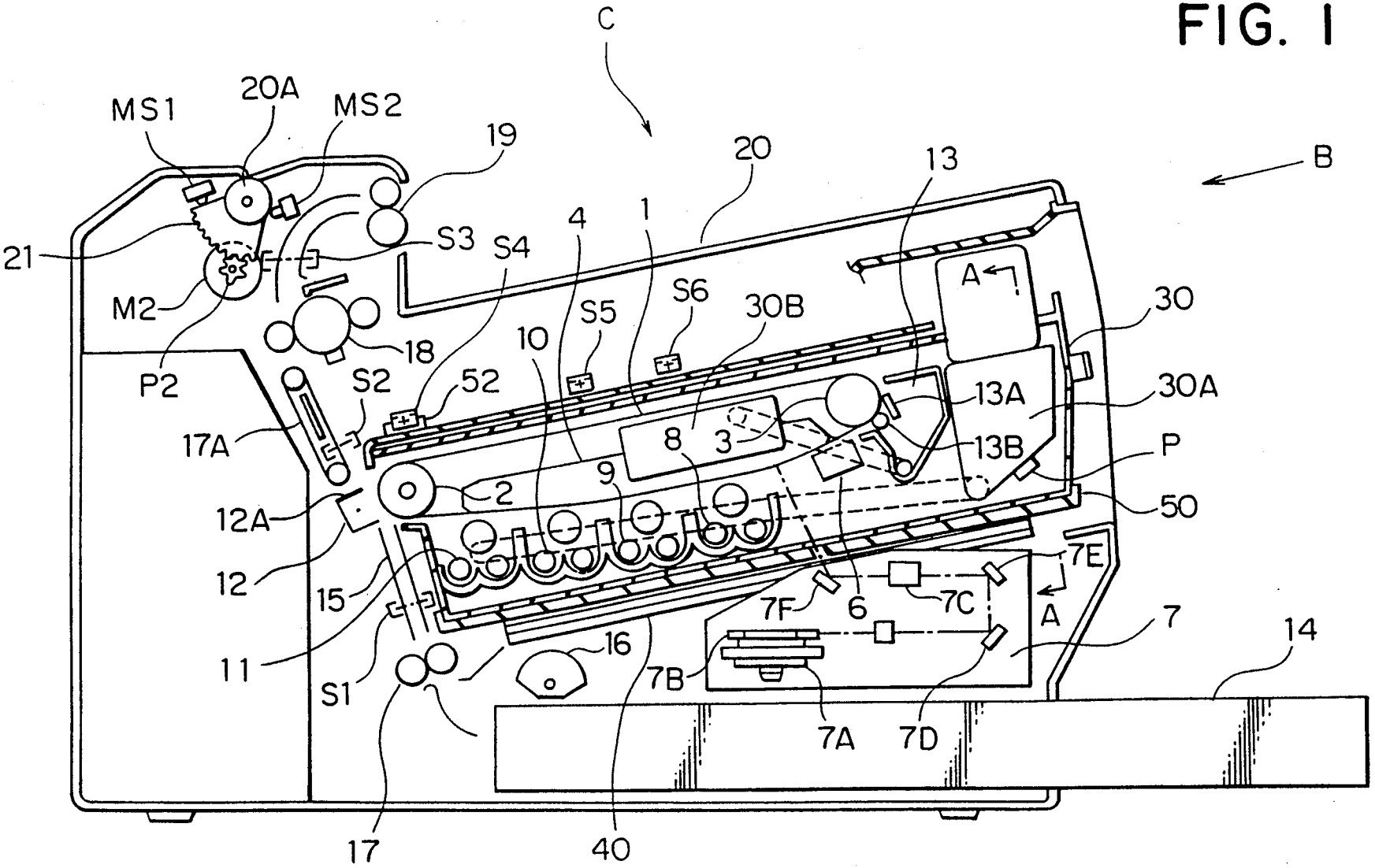
FIGS. 1, 2, 3, 4, 11, and 12 are sectional schematic views of an image forming apparatus of the present invention.

In FIG. 1, numeral 1 indicates a flexible photosensitive belt which is a belt type image carrying member. The photosensitive belt 1 is stretched between rotating rollers 2 and 3 and moved clockwise by the drive of the rotating roller 2.

Numeral 4 indicates a guide member which is fixed to the apparatus body so that it supports internally the photosensitive belt 1. Since the photosensitive belt 1 is stretched by the outward forcing action by the tension roller 3, the inner surface of the belt slides along the guide member 4.

Therefore, the photoconductor on the outer peripheral surface of the photosensitive belt 1 is kept at a constant distance from the surface of the guide member 4 during movement so as to configure a stable image forming surface.

Numeral 6 indicates a scorotron charging unit which is a charging means, 7 a laser write system unit which is an image exposure means, and 8 to 11 a plurality of developing means or developing units containing specific color developers. The above image forming means are provided facing the outer peripheral surface of the photosensitive belt 1, behind which the guide member 4 is installed.

In addition to the optical system shown in FIG. 1, an optical system, comprising a luminous unit and a convergent light transmitter which are integrated, may be used as a laser write system unit 7.

The developing units 8, 9, 10, and 11 contain, for example, yellow, magenta, cyan, and black developers respectively and have developing sleeves which are at a predetermined distance from the photosensitive belt 1 so as to visualize latent images on the photosensitive belt 1 by the non-contact development method. This non-contact development method has an advantage that the movement of the photosensitive belt is not disturbed, unlike the contact development method.

Numeral 12 indicates a transfer unit, 12A a discharging bar, and 13 a cleaning unit. A blade 13A of the cleaning unit 13 and a toner feed roller 13B are kept away from the surface of the photosensitive belt 1 during image forming, and pressed onto the surface of the photosensitive belt 1 as shown in FIG. 1 only when the surface is cleaned after image transfer.

The color image forming process by the above color image forming apparatus is as shown below.

First, a multi-color image is formed by an image forming system indicated below in this embodiment. Data obtained by a color image data input unit wherein an original image is [page 30] scanned by image pick-up elements is processed by an image data processing unit so as to create image data and the image data is stored in an image memory. The image data is retrieved for recording and inputted to a recording unit, for example, the color image forming apparatus shown in the embodiment in FIG. 1.

When a color signal outputted from an image reader which is different from the above printer is inputted to the laser write system unit 7, a laser beam generated by a semiconductor laser (not shown in FIG. 1) is rotationally scanned by a polygon mirror 7B which is rotated by a drive motor 7A in the laser write system unit 7, reflected off of mirrors 7D, 7E, and 7F via a $f\theta$ lens 7C, and irradiated onto the peripheral surface of the photosensitive belt 1 which is charged beforehand by the charging unit 6 which is a charging means so as to form a bright line.

When scanning starts, the beam is detected by an index sensor, the beam by the first color signal starts modulation, and the modulated beam scans on the peripheral surface of the photosensitive belt 1. Therefore, a latent image corresponding to the first color is formed on the peripheral surface of the photosensitive belt 1 by the primary scanning of the laser beam and by the secondary scanning by the movement of the photosensitive belt 1. This latent image is developed by the developing unit 8 of the developing means containing yellow (Y) toner (a developing medium) and a toner image is formed on the drum surface. The toner image formed on the drum surface passes under the cleaning unit 13 (cleaning means) which is away from the peripheral surface of the photosensitive belt 1 and enters the next copy cycle.

The photosensitive belt 1 is charged by the charging unit 6 once again, the second color signal outputted from the signal processing unit is inputted to the write system unit 7, and data is written on the drum surface in the same way as with the first color signal so as to form a latent image. The latent image is developed by the developing unit 9 containing magenta (M) toner as a second color.

This magenta (M) toner image is formed under the condition that the above yellow (Y) toner image, which is formed already, exists.

Numeral 10 indicates a developing unit containing cyan (C) toner, which forms a cyan (C) toner image on the drum surface according to a control signal generated by the signal processing unit.

Numeral 11 indicates a developing unit containing black toner, which superimposes a black toner image on the belt surface by the same processing. A DC or AC bias voltage is applied to each sleeve of the developing units 8, 9, 10, and 11, jumping development is performed by a 2-component developer which is a developing means, and non-contact development is performed on the photosensitive belt 1 whose base is grounded. Non-contact development using a 1 component developer may be performed.

Color toner images formed on the peripheral surface of the photosensitive belt 1 are transferred to a transfer material, which is sent from a paper feed cassette 14 via a paper feed guide 15, at the transfer unit.

The top one of transfer sheets of paper contained in the paper feed cassette 14 is conveyed by the rotation of a paper feed roller 16 and fed to the transfer unit 12 via timing rollers 17 with the timing of image forming on the photosensitive belt 1.

The transfer sheet, which has a transferred image and is discharged, separates surely from the photosensitive belt 1 which changes direction suddenly around the rotating roller 2 and moves up via a suction conveyor belt 17A. The image is melted and fixed by fixing rollers 18 and then the transfer sheet is ejected onto a tray formed on an upper lid 20 via paper ejection rollers 19.

The photosensitive belt 1, after image transfer to the transfer sheet has finished, continues to move, and remaining toner is removed by the cleaning unit 13 wherein the blade 13A and the toner cleaning roller 13B are pressed to the belt. Then, the blade 13A is separated from the belt once again, the toner cleaning roller 13B smooths toner accumulated on the tip of the blade 13A a little while later, the toner cleaning roller 13B is separated from the belt, and the apparatus enters a new image forming process.

The photosensitive belt 1, charging unit 6, developing units, and cleaning unit 13 are incorporated and integrated into an independent process cartridge 30 as process supplies for image forming so as to be mounted or removed from the apparatus body.

Figure 5:
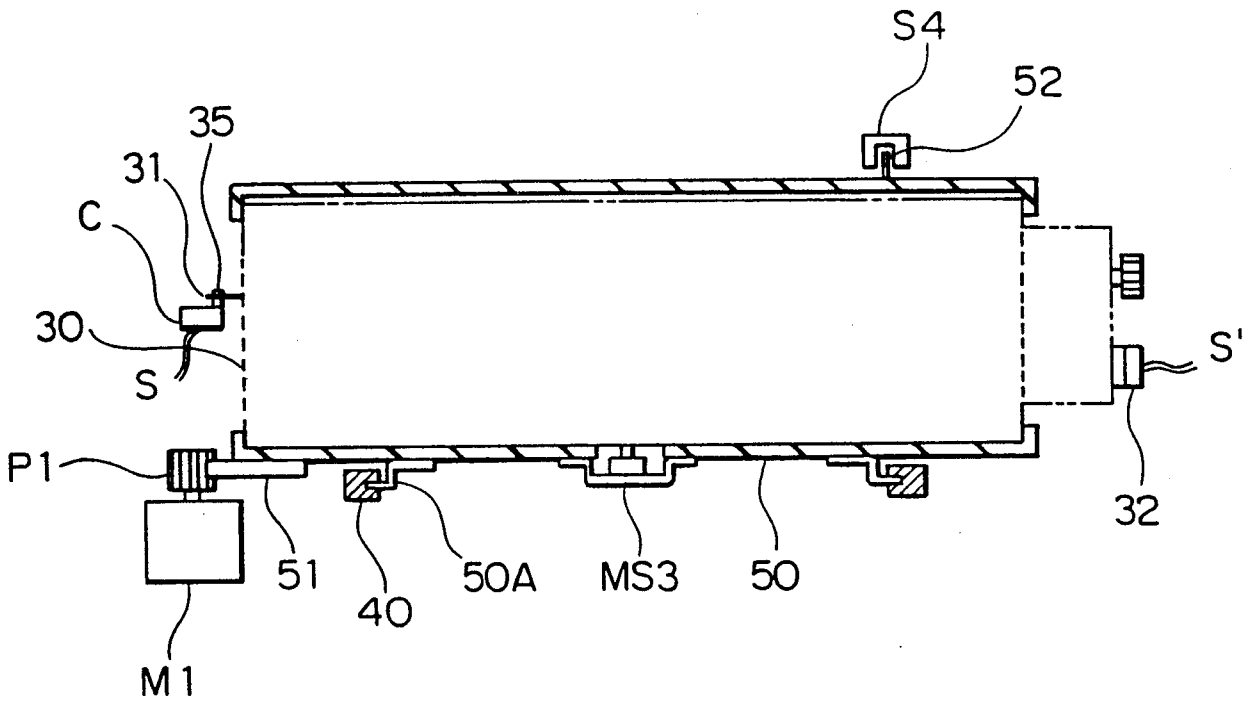
FIGS. 5, 6, 7, and 8 are sectional and plan views of the essential section and perspective and side views of the essential section.

In the apparatus, as shown in FIG. 5 showing the section AA, a frame 50 with legs 50A at the bottom which are engaged with a pair of fixed guide rails 40 is slidably supported, and the process cartridge 30 is mounted on the frame 50.

Figure 2:
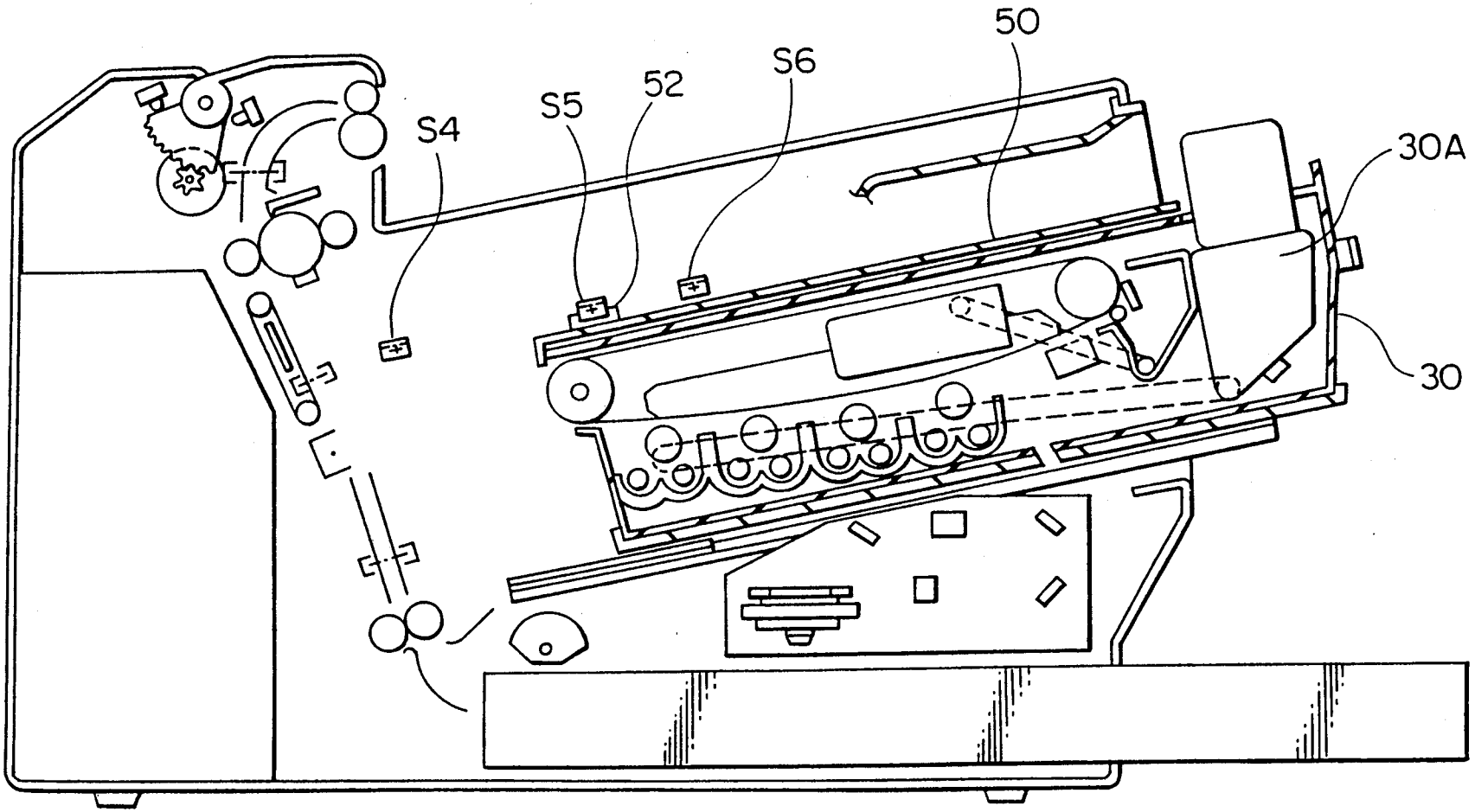
Figure 3:
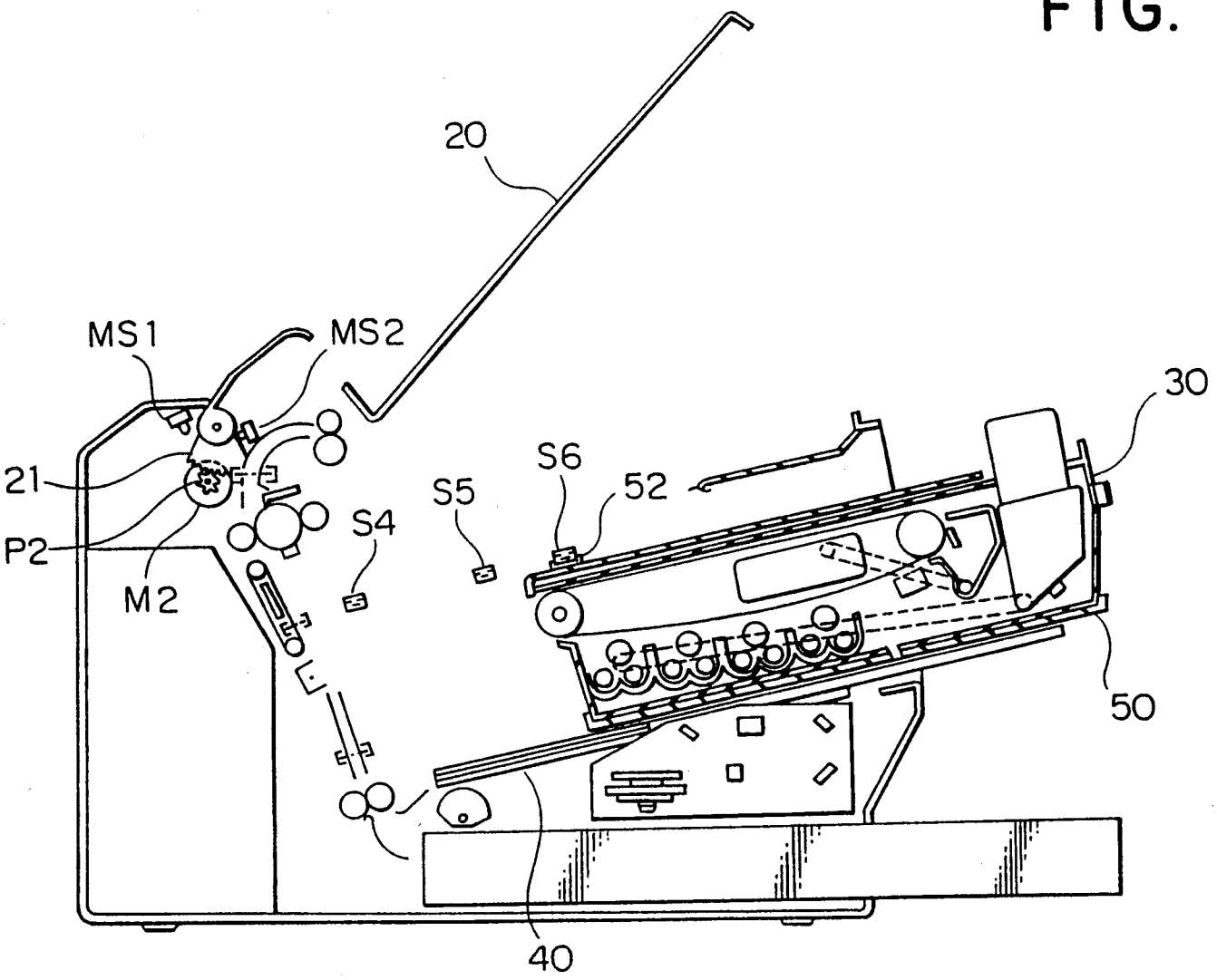

The frame 50 has a rack plate 51 which is engaged with a pinion P1 of a motor M1 of the apparatus body, and moves up slantwise in parallel as shown in FIG. 2 or 3 by the rotation of the motor M1 so as to protrude from the side of the apparatus body, and is held at a predetermined position.

The upper lid 20 is supported by the apparatus body via a shaft 20A so that it can rotate. When the upper lid rotates counterclockwise, it opens and the opening at the upper part of the apparatus body is uncovered.

The upper lid 20 has a sector gear 21 at the rotation base which is engaged with a pinion P2 of a motor M2 of the apparatus body, and rotates counterclockwise as shown in FIG. 3 by the rotation of the motor M2 and is held at a predetermined angle.

The movement of the frame 50 or the opening of the upper lid 20, that is, the rotation of the motor M1 or M2 starts automatically in synchronization with the cycle of replacement, checking, or replenishment of process supplies or an occurrence of transfer material feed trouble.

The process cartridge 30 has a counter function for adding up the frequency of use of process supplies. When a new process cartridge is mounted in the apparatus body, a protrusion 31 on the side of the cartridge shown in FIG. 5 presses a reset lever 35 of a counter C installed in the apparatus body so as to return the indication of the counter C to 0, and the counter C records the frequency of use thereafter. When the durable use frequency of the blade 13A of the cleaning unit 13 or the durable use frequency of the drum reaches a predetermined reference value, the counter C outputs a signal S.

EXAMPLE

| | | |
|---|---|---|
| Durable use frequency of blade: | 20000 | |
| Durable use frequency of drum: | 60000 | |
| Cleaning replacement signal: | 20000, 40000, 60000 | A signal S is outputted. |
| Drum replacement signal: | 60000 | |

When a new process unit is inserted at the time 60000 has been counted, the counter C is reset.

The cycle of replacement or checking of the photosensitive drum 1, charging unit 6, developing units, or cleaning unit 13 is detected by this signal.

The proposal indicated in Utility Model Patent 8295/1990 by the inventor of this invention is applied to the protrusion 31, and the counter C is prevented from being reset by the same cartridge 30 once again.

The process cartridge 30 contains a developer replenishment unit 30A comprising four toner replenishment hoppers for replenishing toners to the developing units and a waste toner cartridge 30B for storing collected toner.

The developer replenishment unit 30A comprises four toner cartridges filled with yellow (Y), magenta (M), cyan (C), and black (BK) toners respectively, and those toners are always dropped into the corresponding toner replenishment hoppers so that they can be replenished any time.

The developer replenishment unit 30A is provided with a sensor P as a detection means for detecting exhaustion of developer or toner. When the remaining quantity of stored toner falls below a preset value, an electric signal S' is outputted and transferred to the apparatus body via a connector shown in FIG. 5.

The waste toner cartridge 30B contains a sensor for detecting the toner collection amount. When the toner storage quantity exceeds a preset value, the above electric signal S is outputted and transferred to the apparatus body.

At the time of replacement in the maintenance cycle or replenishment or replacement of expendable supplies, a replacement indication is indicated on an operation indication unit 60 upon receipt of the signal S or S'.

Photosensors S1, S2, and S3 for detecting passing of a transfer material are installed at important locations on the transfer material feed path. When a sensor located on the down-stream side of each feed path does not detect a transfer material within a predetermined time (in seconds) after a sensor located on the up-stream side detects passing of the transfer material, a jam detection signal S" (not shown in the drawing) is outputted and a jam occurrence of the transfer material is detected.

Each above detection signal is inputted to the control unit of the apparatus body and outputted as a signal for controlling the rotation of the motor M1 or M2. A jam indicator lamp L1 of the operation indication unit 60 lights.

Figure 8:
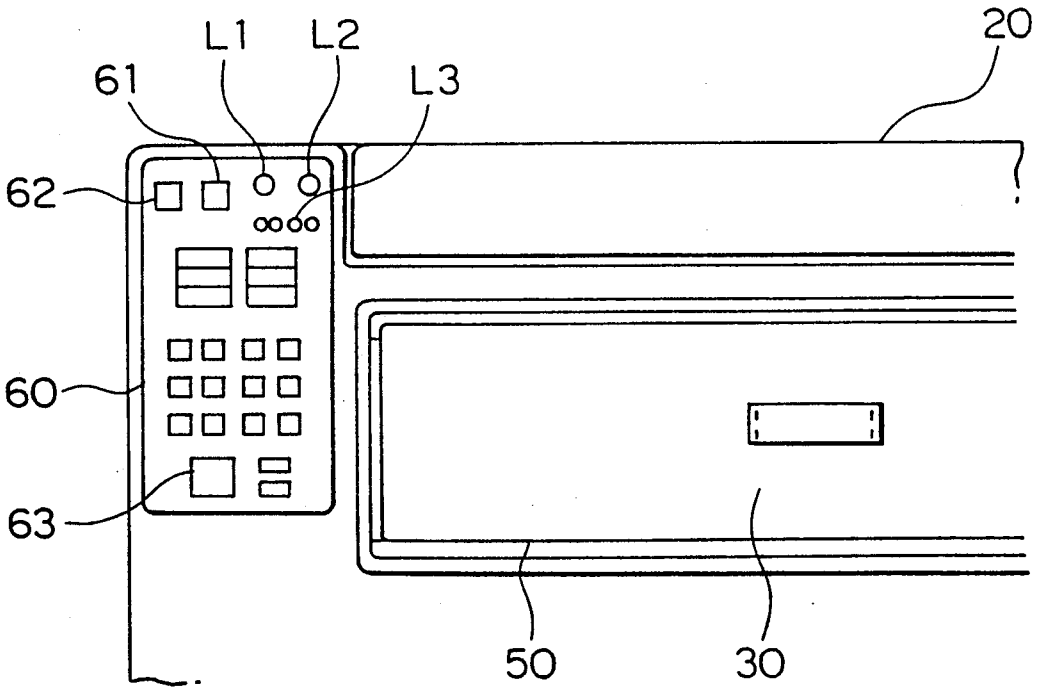

The operation indication unit 60 of the apparatus installed on the front of the apparatus or on the side indicated by the arrow B shown in FIG. 1 comprises, as shown in FIG. 8, a lamp L1 for indicating a jam occurrence of a transfer material, a lamp L2 for indicating replacement of process supplies, a lamp L3 for indicating replenishment of a developer, a Reset button 61 for starting to drive the motor M1 or M2 in the reverse direction, and an Eject button 62 for starting to drive the motor M1 or M2 in the forward direction.

When the jam detection signal (S") or the signal (S or S') for detecting replacement of process supplies or for detecting replenishment of developers is inputted to the control unit of the apparatus body, the lamp L1, L2, or L3 lights for indication.

Figure 9:
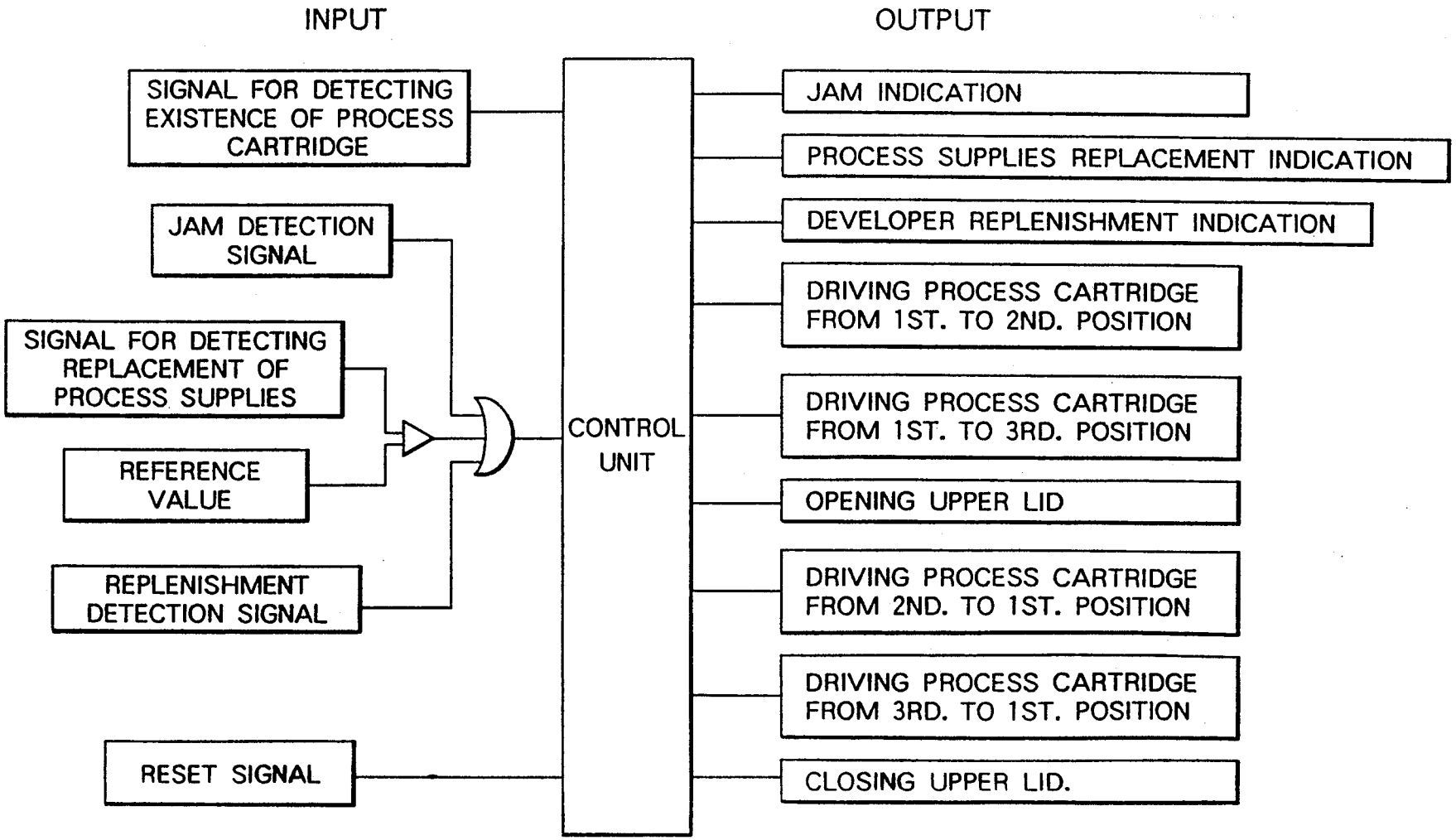
FIG. 9 is a control circuit diagram, and FIGS. 10(*a*), 10(*b*) and 10(*c*) are flow charts showing a control process.

The rotation control process for the motor M1 or M2 by inputting each of the above signals will be described hereunder with reference to the control unit circuit shown in FIG. 9 and the flow charts shown in FIG. 10.

First, a case that the toner in the developer replenishment unit 30A becomes low amount and the toner replenishment time is detected by the sensor P will be described.

Figure 6:
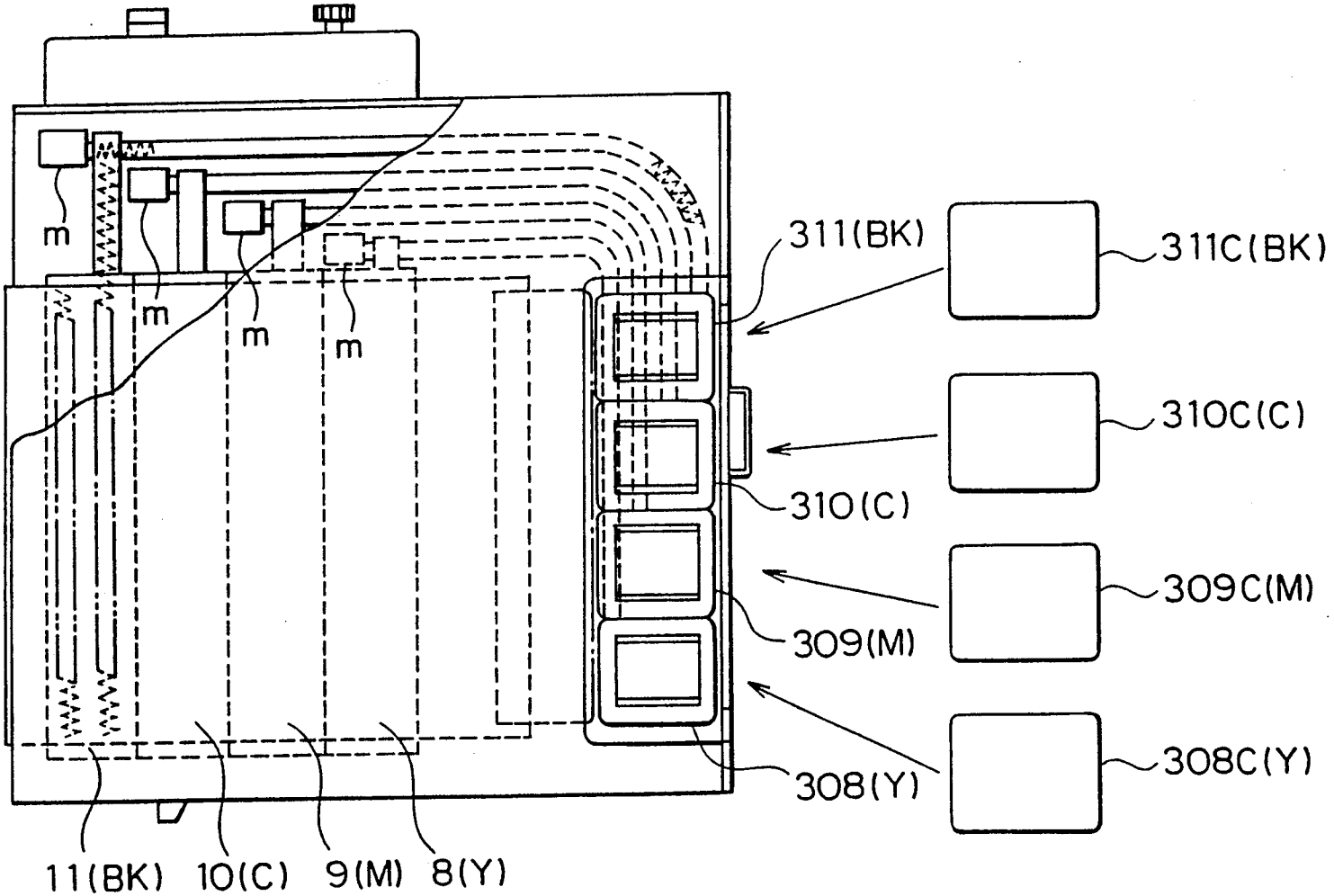

FIG. 6 is a plan view of the process cartridge 30 viewed in the direction of the arrow C shown in FIG. 1, and the developer replenishment unit 30A comprises toner replenishment hoppers 308, 309, 310, and 311 containing yellow (Y), magenta (M), cyan (C), and black (BK) toners respectively.

Each toner replenishment hopper is connected to the corresponding developing unit via a replenishment tube containing a flexible feed screw and replenishes toner to the developing unit by the rotation of a motor "m" corresponding to an image density detection signal.

Figure 10:
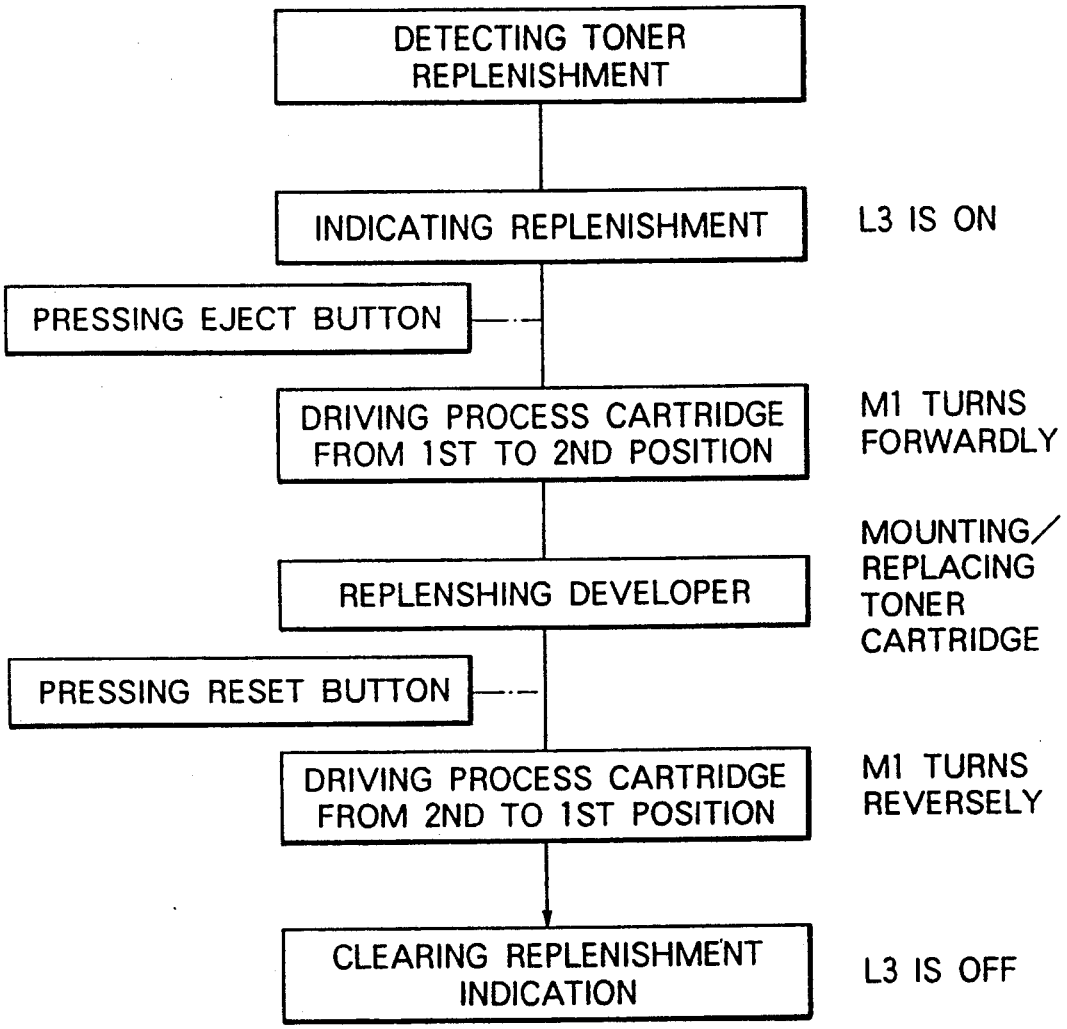
Figure 10:
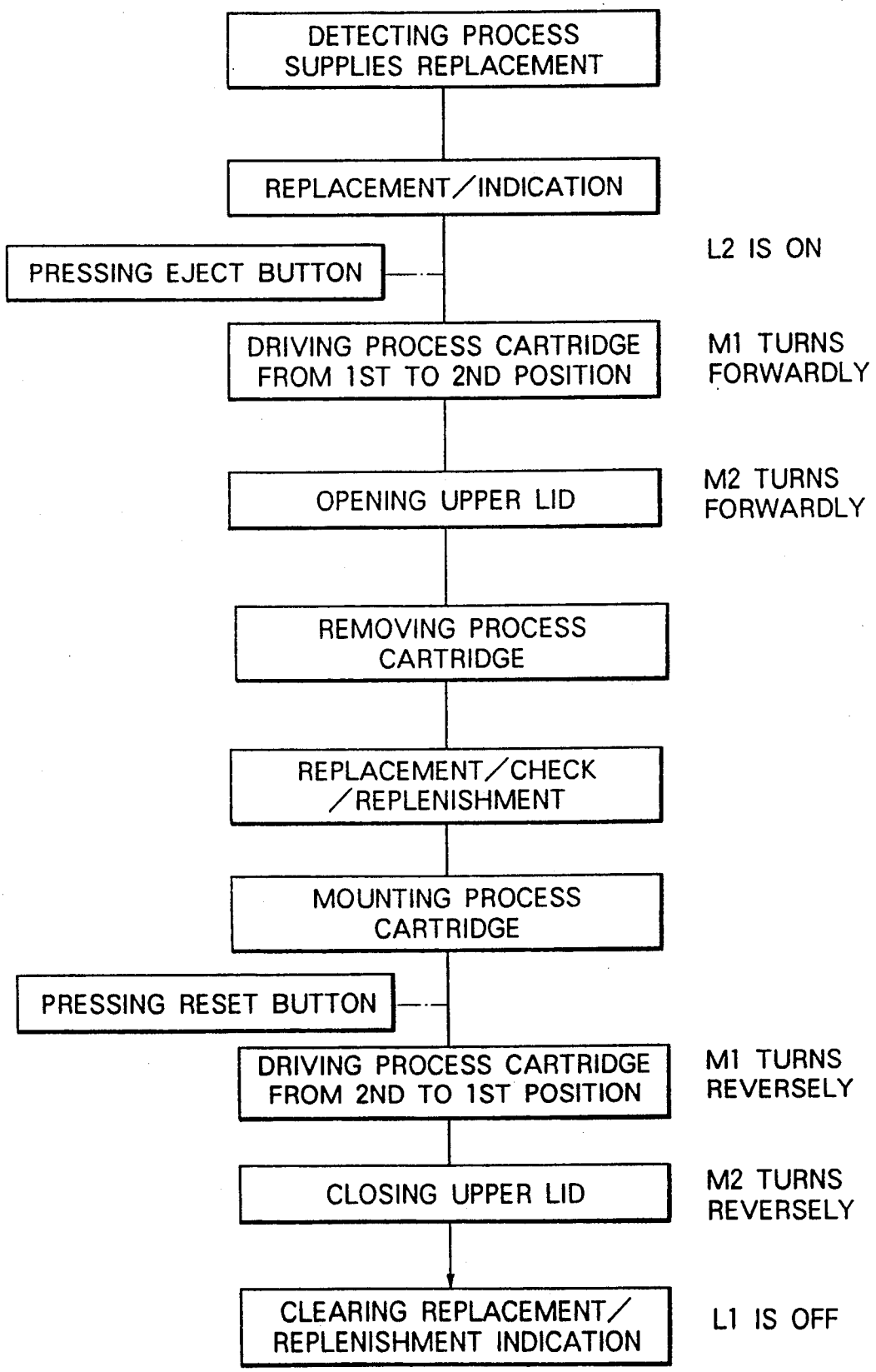
Figure 10:
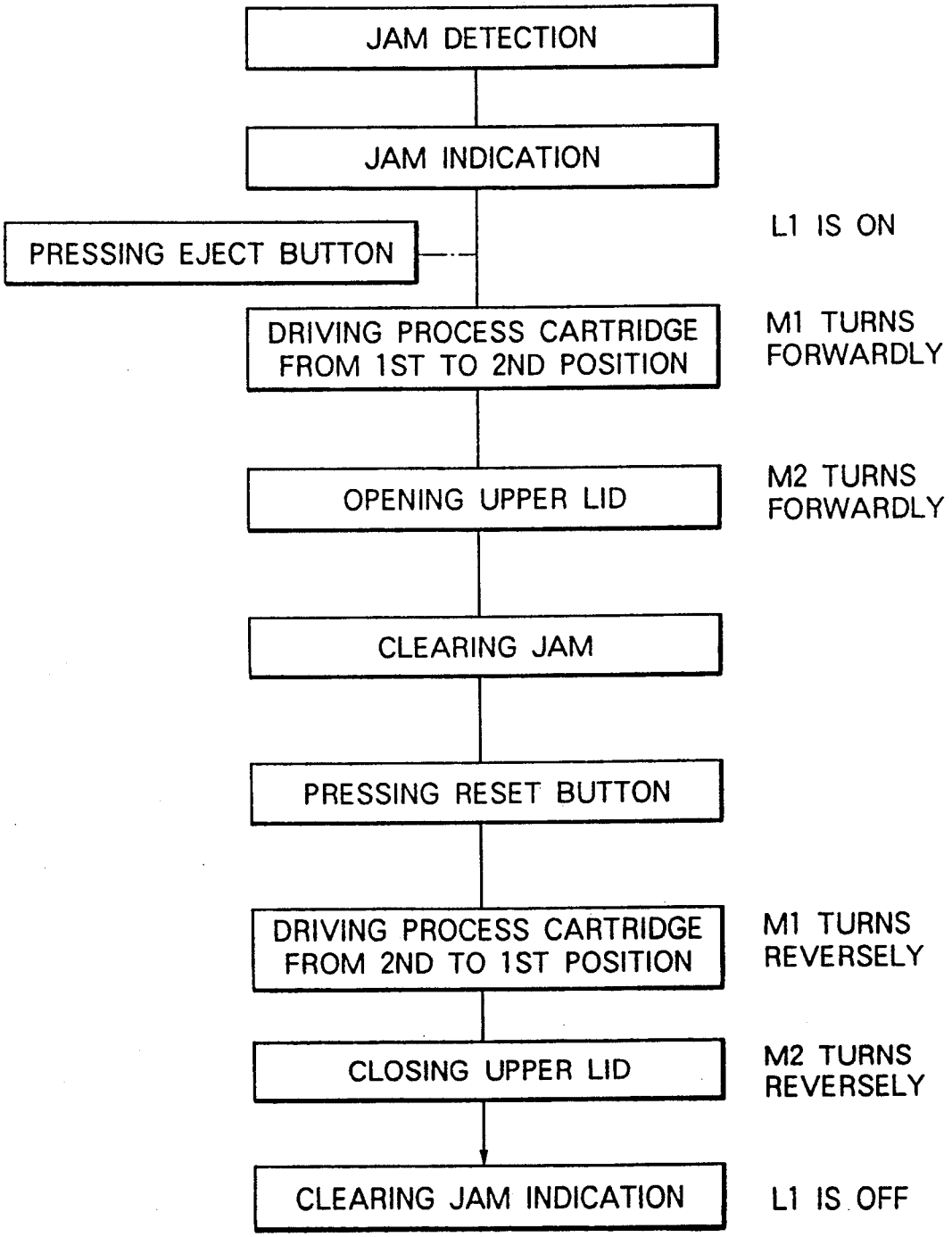

When the toner replenishment signal S' to the toner replenishment hopper is outputted, the lamp L3 (preferably a lamp corresponding to the color toner to be replenished as shown in FIG. 10(*a*)) lights first as shown in FIG. 10(*a*) so as to indicate to an operator the necessity of toner replenishment to the toner replenishment hopper and a signal for supplying a voltage for forward rotation is outputted to the motor M1 simultaneously.

By the forward rotation of the motor M1, the frame 50 moves from the position shown in FIG. 1 to the position shown in FIG. 2, and the motor M1 stops rotation at the position where a light shield plate 52 on the top of the frame changes a photosensor S5 of the apparatus body from ON to OFF.

As a result, the process cartridge 30 moves from the first position in the apparatus where images can be formed to the second position where a developer or toner can be replenished and allows each toner replenishment hopper to protrude from the apparatus so as to disclose the top.

Furthermore, as a result, the process cartridge 30 moves from the first position in the apparatus where images can be formed to the second position where the developer replenishment container or the toner cartridge can be replaced and allows each toner replenishment hopper and the toner cartridge to protrude from the apparatus.

Toners can be automatically replenished to the toner replenishment hoppers 308, 309, 310, and 311 by mounting toner cartridges 308C, 309C, 310C, and 311C containing yellow (Y), magenta (M), cyan (C), and black (BK) toners respectively as shown in FIG. 6.

Figure 7:
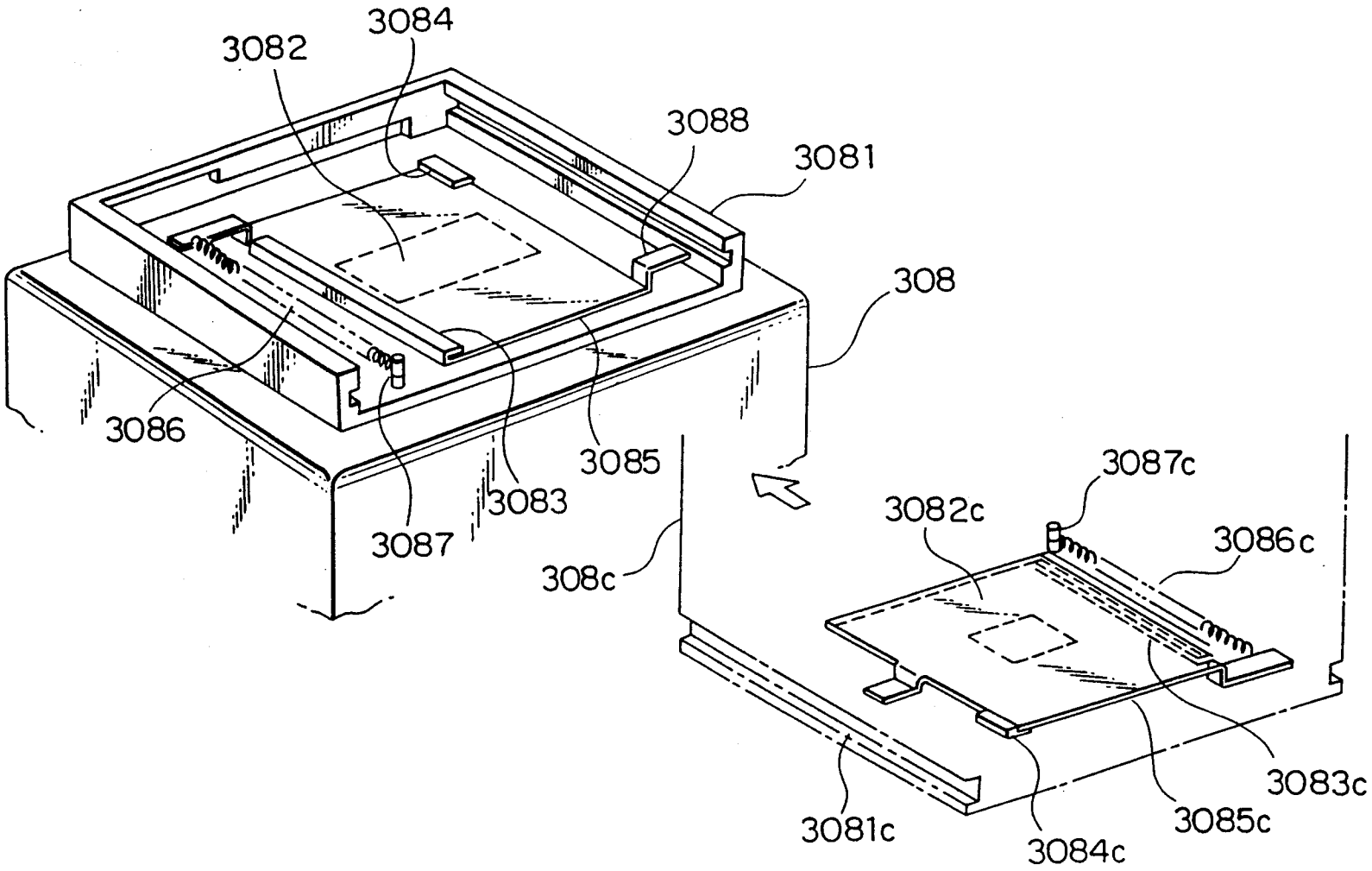

The toner replenishment operation will be described using an example of the toner cartridge 308C for the toner replenishment hopper 308 with reference to FIG. 7.

A guide plate 3081 which is engaged with the toner cartridge 308C is fixed to the top of the toner replenishment hopper 308 and a toner inlet 3082 is open.

The toner inlet 3082 is covered with a shutter plate 3085 which is supported by guide rails 3083 and 3084 so that it can slide and is always shielded by the shutter plate 3085 by the force applied by a tension spring 3086 attached to the shutter plate 3085 in the direction opposite to the arrow.

A step 3081C, which is engaged with the above guide plate 3081 of the toner replenishment hopper 308 in internal touch, is formed at the bottom of the toner cartridge 308C, and a toner drop port 3082C is open in the center of the bottom.

The toner drop port 3082C is covered with a shutter plate 3085C which is supported by guide rails 3083C and 3084C so that it can slide and is always shielded by the shutter plate 3085C by the force applied by a tension spring 3086C attached to the shutter plate 3085C in the direction opposite to the arrow.

When the toner cartridge 308C is slid and inserted into the toner replenishment hopper 308 in the direction of the arrow so that the step 3081C is engaged with the guide plate 3081, a spring holding pin 3087C on the cartridge side presses a rising part 3088 of the shutter plate 3085 on the hopper side so as to move the shutter plate 3085 in the direction of the arrow, and simultaneously a rising part 3088C of of the shutter plate 3085C on the cartridge side touches a spring holding pin 3087 on the hopper side so as to insert the cartridge and to move the shutter plate 3085C in the direction opposite to the arrow.

Therefore, when the step 3081C is inserted until it touches the inner wall of the guide plate 3081, the toner inlet 3082 and the toner drop port 3082C coincide with each other in position and are fully open, and toner in the toner cartridge 308C automatically flows and drops into the toner replenishment hopper 308 for replenishment.

When the toner cartridge 308 is removed from the guide plate 3081 after replenishment, the toner inlet 3082 and the toner drop port 3082C are automatically shielded by the action of the tension springs 3086 and 3086C once again.

When the Reset button is manually pressed after the toner cartridge 308C is removed, power for reverse rotation is supplied to the motor M1, the process cartridge 30 starts movement from the second position to the first position, the motor M1 stops rotation at the position where the light shield plate 52 changes the photosensor S4 from OFF to ON, the apparatus enters the state that an image can be formed, and the lamp L3 goes off.

This embodiment has a structure that the entire process cartridge 30 moves to the second position for toner replenishment. However, a structure that the developer replenishment unit 30A and the developing units connected thereto are integrated to a unit which can move independently and only the unit is moved from the first position to the second position for toner replenishment may be used.

Figure 4:
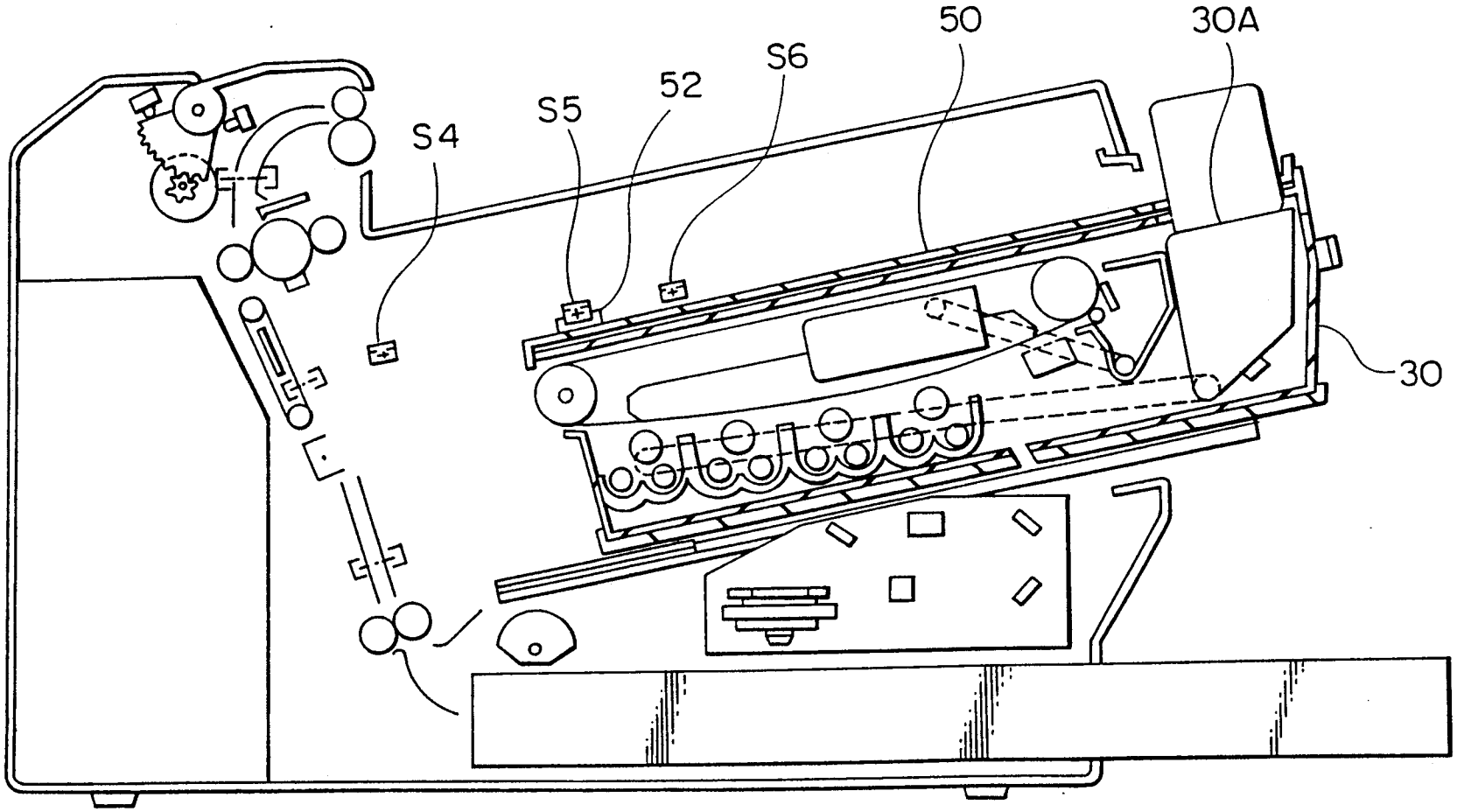

Furthermore, a structure that the above toner cartridges are not mounted in the process cartridge 30 and when the process cartridge 30 moves to the second position as shown in FIG. 4, the toner cartridges are mounted in the process cartridge and toners are replenished temporarily to the toner replenishment hoppers, may be used.

It is possible to move the process cartridge 30 or the above unit to the second position by manually pressing the Eject button.

Next, a case that the time for replacing process supplies is detected by the counter C or an occurrence of a transfer material jam is detected by one of the photosensors S1 to S3 will be described.

When a signal S by the counter C or signal S'' by one of the photosensors S1 to S3 is inputted to the control unit, the lamp L2 or L1 lights first as shown in FIG. 10(*b*) or 10(*c*) so as to indicate replacement of process supplies or an occurrence of a transfer material jam, and signals for supplying forward rotation power to the motors M1 and M2 are outputted.

By the forward rotation of the motor M1, the frame 50 moves from the position shown in FIG. 1 to the position shown in FIG. 2 and the motor M1 stops rotation at the position where the light shield plate 52 on the top thereof changes the photosensor S6 from ON to OFF.

As a result, the process cartridge 30 moves from the first position where images can be formed in the apparatus to the second position where a transfer material jam can be cleared easily from the transfer material feed path with the inner space widely opened and the process cartridge 30 can be inserted or removed from the apparatus body. Therefore, the process cartridge 30 can be easily removed from the frame 50 and process supplies can be efficiently replaced or checked.

After this processing or simultaneously with this processing, the motor M2 rotates forward, the upper lid 20 rotates from the angle shown in FIG. 1 to the angle shown in FIG. 3 so as to open the opening of the apparatus body, and the motor M2 stops rotation at the angle at which the sector gear 21 presses the switch MS2 of the apparatus body so as to change the switch from OFF to ON.

Therefore, a transfer material jam can be easily cleared, combined with the movement of the process cartridge 30.

When the process cartridge 30, which is removed from the frame 50 for replacing or replenishing process supplies, is mounted on the frame 50 once again as shown in FIG. 10(*b*), the bottom of the cartridge 30 presses the switch MS3 so as to change the switch from OFF to ON, a signal for detecting existence of the process cartridge 30 is inputted, and signals for supplying reverse rotation power to the motors M1 and M2 are outputted.

As a result, the process cartridge 30 moves from the second position to the first position once again, the motor M1 stops rotation at the position where the light shield plate 52 changes the photosensor S4 of the apparatus body from OFF to ON, and each process supply is kept in the state that images can be formed.

By the reverse rotation of the motor M2, the upper lid 20 rotates clockwise and stops rotation at the angle where the sector gear 21 changes the switch MS1 from OFF to ON, the opening on the top of the apparatus body is closed, and the apparatus becomes ready for copying.

When a transfer material jam is cleared with the process cartridge 30 mounted on the frame 50, by pressing the Reset button 61 of the operation indication unit 60 as shown in FIG. 10(*c*), the action of the switch MS3 is selected and signals for supplying reverse rotation power to the motors M1 and M2 are outputted.

The jam indication lamp L1 or the replacement indication lamp L2 automatically turns OFF when the process cartridge returns to the first position or the upper lid 20 closes.

It is possible to install an Eject button 62 in the operation indication unit 60 and to rotate the motors M1 and M2 forward by pressing the button for replacing process supplies due to exhaustion. Furthermore, it is possible to press the Reset button 61 before or after the process cartridge 30 is installed so as to start the motors M1 and M2 to rotate reversely in optional timing, in consideration of the safety of the operator for automatic opening and closing.

After the lamp L1 or L2 is checked to be on, movement of the process cartridge 30 or opening or closing of the upper lid can be performed by operating the button. Therefore, the mechanism is simplified and the operation is guaranteed to be safe.

Figure 11:
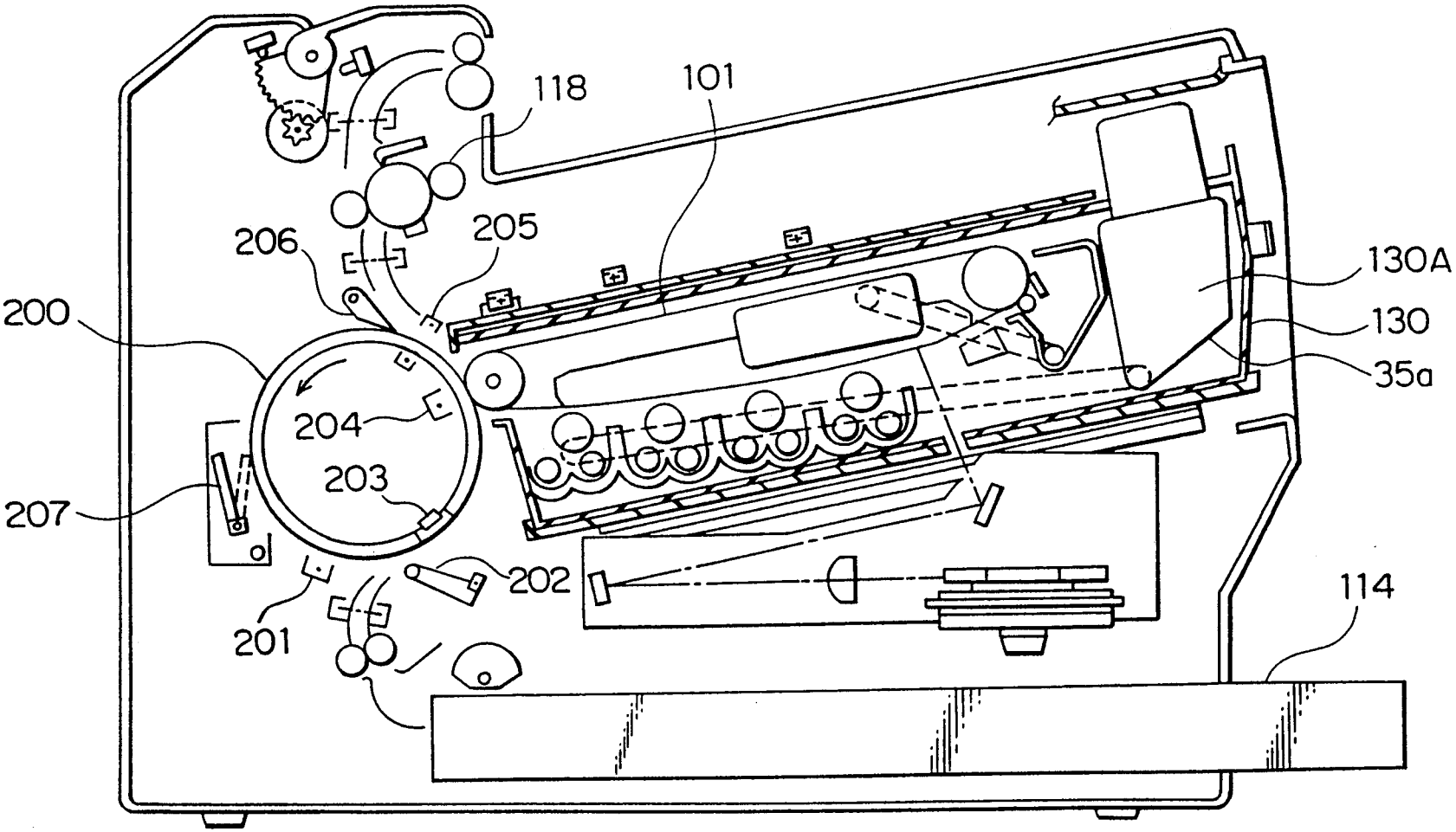

FIG. 11 shows an image forming apparatus of a transfer drum type as another embodiment of the present invention. A photosensitive belt 101 and a process cartridge mounted around it are almost the same as those used in the previous embodiment, except that a transfer drum 200 is mounted in contact with a transfer part of the photosensitive belt and rotates in synchronization with the photosensitive belt 101 in the direction of the arrow (counterclockwise), and except that a toner hopper 35*a* is integrated in the process cartridge 15. A transfer material is wound round the outer periphery of the transfer drum 200, a toner image is transferred onto the wound transfer material, and the transferred toner image is superimposed. The transfer material is separated from the transfer drum 200 and ejected on the apparatus after fixing.

A charging unit 201 for electrostatically attracting a transfer material and a winding unit 202 for mechanically winding a transfer material round the transfer drum 200 are installed around the transfer drum 200. The winding unit 202 has a roller at the head thereof and the roller touches the transfer drum 200 only at the start of winding a transfer material round the transfer drum. A gripper 203 is mounted on the peripheral surface of the transfer drum 200 so as to hold the leading edge of a transfer material fed in synchronization. Numeral 204 indicates a transfer unit which electrostatically transfers a toner image on the photosensitive belt 101 onto a transfer material. Numeral 205 indicates a separation discharging electrode and 206 a separation clutch pin. Numeral 207 indicates a cleaner which can contact or separate from the transfer drum 200 and removes toner attached to the transfer drum 200 after a transfer material has been separated.

A transfer material ejected from a paper feed cassette 114 enters the transfer drum 200 which is charged by the charging unit 201 in a synchronized timing and is wound by the winding unit 202 and rotated toward the transfer part with the leading edge thereof held with the gripper 203. At the transfer part, a yellow (Y) toner image, which is formed on the photosensitive belt 101 by the transfer unit 204, is transferred onto the transfer material. The transfer drum 200, which has finished the first transfer, continues rotation and superimposes a magenta (M) toner image at the second rotation, a cyan (C) toner image at the third rotation, and a black (BK) toner image at the fourth rotation successively. When the four-color toner images are transferred, the transfer material is discharged by the separation discharging electrode 205, separated from the transfer drum after the head of the transfer material is released by the separation clutch pin 206, and fed to a fixing roller 118.

The image forming apparatus of this embodiment is structured so that the transfer drum 200 is installed on the apparatus body side but not contained in a process cartridge 130 which can be moved or removed. Therefore, the process cartridge 130 can be inserted or removed, a jam can be cleared, or toner can be replenished in the same way as in the previous embodiment.

Figure 12:
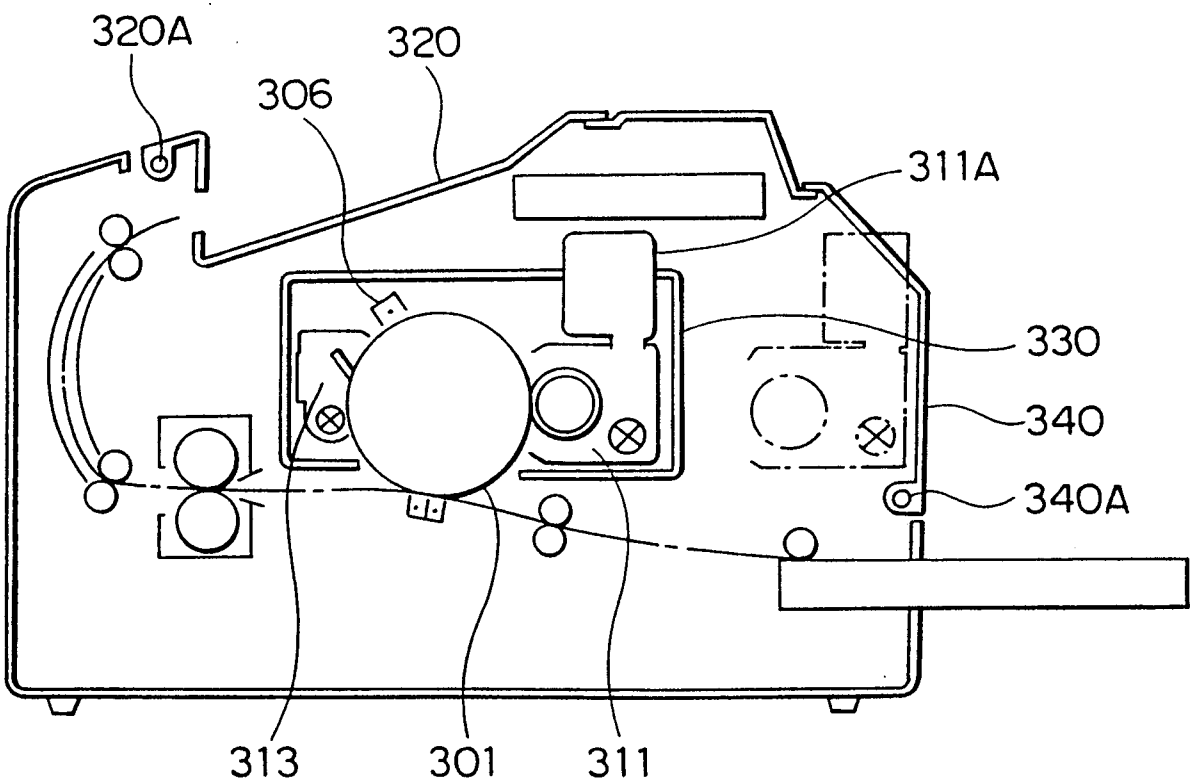

The present invention can be applied to a monochromatic image forming apparatus as shown in FIG. 12.

In this embodiment, a process cartridge 330 contains a photosensitive drum 301, a charging unit 306, a cleaning unit 313 as well as a pair of developing units 311 containing a black developer and a toner replenishment hopper 311A. By a signal detecting replenishment of developer or replacement of process supplies, in the same way as with a full-color image forming apparatus previously described, only the developing unit 311 and toner replenishment hopper 311A shown in the drawing move to the second position for toner replenishment indicated by the alternate long and short dash line shown in the drawing or the entire process cartridge 330 moves from the first position to the second or to a third position by sliding to the right. Before starting movement, a replenishment indicator lamp lights and a side cover 340 is opened clockwise round a shaft 340A simultaneously so that the process cartridge 330 can be protruded from the apparatus.

When a transfer material jam is detected, the process cartridge 330 moves to the third position (the position is not shown in the drawing but may be on the right or left of the alternate long and short dash line shown in FIG. 12, or a further rightward position from the dash line where the process cartridge 330 can be removed when the cover 340 is open), a top cover 320 is opened counterclockwise round a shaft 320A simultaneously so as to open the upper part of the apparatus body (in this case, the third position is on the left of the alternate long and short dash line shown in the drawing or on either of both sides of the dash line including the dash line when the cover can be opened on both sides), and a transfer material jam can be easily processed.

The configuration of each detection signal and control of the operation of each unit are the same as those in the above embodiments.

Next, the present invention will be described on the basis of another embodiment shown in FIG. 13.

Figure 13:
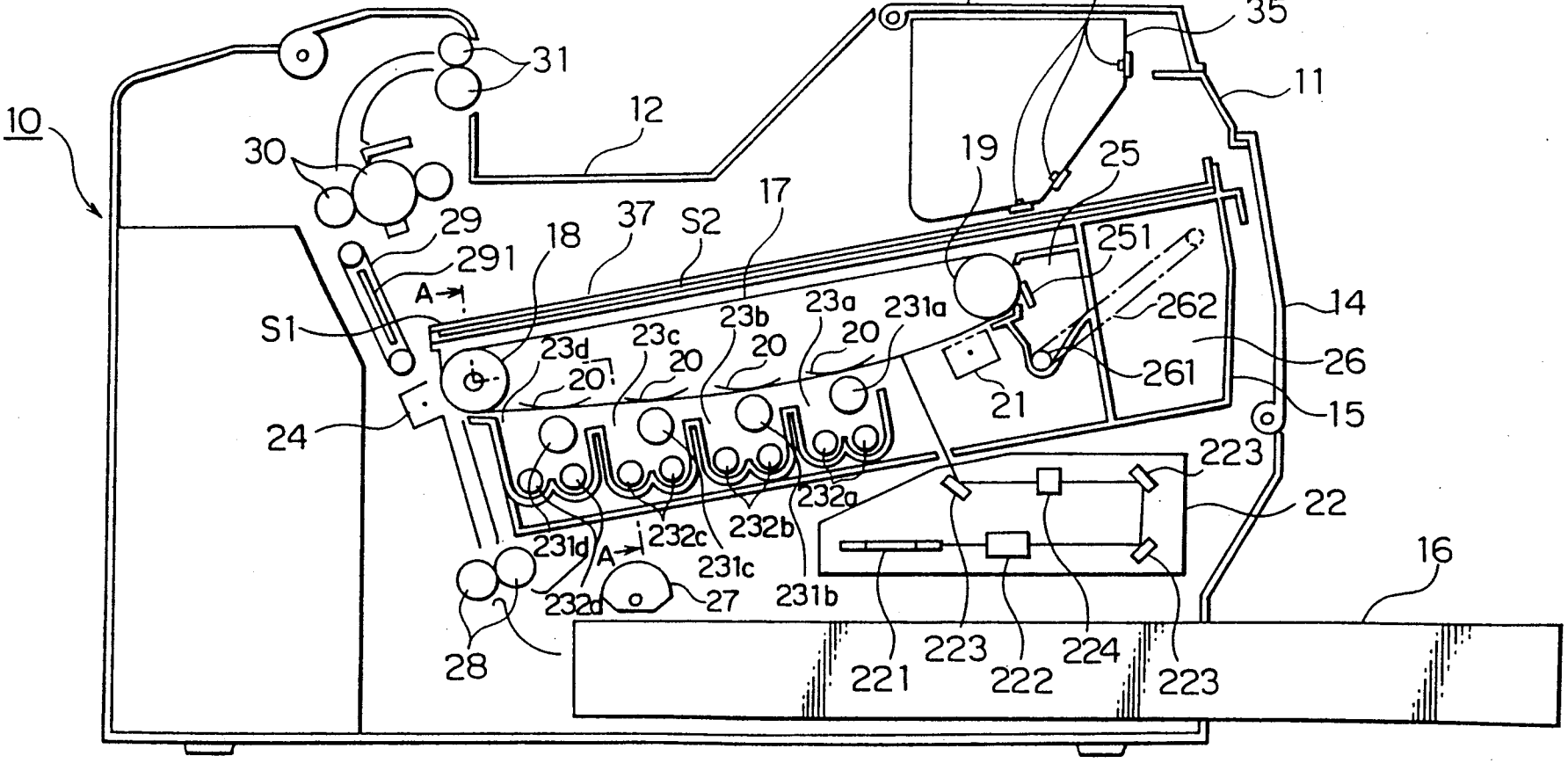
FIG. 13 is a main sectional view of a color printer from the left side, whereto the present invention is applied, FIGS. 14(*a*) and 14(*b*) are flow charts showing life detection processes, FIGS. 15(*a*) and 15(*b*) are control block diagrams showing process cartridge movement control systems.

FIG. 13 is a main sectional view of a color printer on the left side, whereto the present invention is applied. The front of an apparatus body 10 is surrounded by an operation panel 11, an upper cover 12 which can be freely opened or closed, a toner feed cover 13, and a front cover 14, and the main unit contains a process cartridge 15 which can be freely mounted or removed and a paper feed cassette 16.

In FIG. 13, a photosensitive belt 17, which is an image carrying member, is a flexible belt whose surface is coated with a photosensitive layer and stretched between a drive roller 18 and a follower roller 19. The drive roller 18 rotates via a drive gear (not shown in the drawing) engaged with a gear installed on the apparatus body 10 so as to move the photosensitive belt 17 clockwise. The distance between developing units 23 and the photosensitive belt 17 is kept constant by spacers 20 so as to form stable and satisfactory images. The photosensitive belt 17 is used as an image carrying member in this embodiment. However, the present invention can be applied to existing image carrying members having a photosensitive layer such as a photosensitive drum.

Around the photosensitive belt 17, a charging means 21, an exposure means 22, a developing means 23, a transfer means 24, and a cleaning means 25 are installed.

The charging means is installed so as to uniformly charge a photosensitive layer on the surface of the photosensitive belt 17 with a predetermined polarity, and a conventional charging unit 21 such as a corona charging unit or a scorotron charging unit is used. A scorotron charging unit is preferably used for an OPC photoconductor.

The exposure means is a semiconductor laser write system unit 22, which exposes the surface of the photosensitive belt 17, which is charged by the charging unit 21, so as to form a latent image.

The developing means comprises a plurality of developing units 23*a* to 23*d* containing different color developers, for example, yellow, magenta, cyan, and black. The developing units 23*a* to 23*d* comprise developing sleeves 231*a* to 231*d* keeping the distance from the photosensitive belt 17 constant and stirring screws 232*a* to 232*d* for stirring developers, and electrostatic latent images on the photosensitive belt 17 are developed by the non-contact development method. Since the non-contact development method, unlike the contact development method, does not damage toner images previously formed on the photosensitive belt 17 and does not impede movement of the photosensitive belt 17, satisfactory images can be obtained. As to development, not only four-color toners as shown in this embodiment, but also single color, two-color, or three-color toners may be used. In this case, developing units equal to toner colors in number are required to be installed around the photosensitive belt 17. The transfer means transfers a toner image formed on the photosensitive belt 17 onto a transfer material using a transfer unit 24 such as a transfer corona discharging unit. A conventional transfer member such as a transfer drum may be used in place of the transfer unit 24 as a transfer means.

The cleaning means 25 has a cleaning blade 251, which is kept away from the surface of the photosensitive belt 17 during the image forming process and pressed to the surface of the photosensitive belt 17 only during cleaning after a toner image is transferred to a transfer material so as to clean the photosensitive belt 17.

A collection box 26 collects and stores remaining toner from the photosensitive belt 17, which is removed by the cleaning means 25, by a waste toner screw 261 via a toner collection tube 262.

In this embodiment, the process means such as the photosensitive belt 17, charging unit 21, developing units 23*a* to 23*d* containing color toners, cleaning means 25, and toner collection box 26 are integrated and contained in a process cartridge 15 and can be installed in or removed from the apparatus body 10 together. There are no restrictions on process units which are integrated in the process cartridge 15. It is sufficient if at least the photosensitive belt 17 and developing units 23*a* to 23*d* or the photosensitive belt 17 and cleaning means 25 are integrated, and other process units may be added.

The color image forming process by a color image forming apparatus having the above configuration is as follows:

The process cartridge 15 is mounted at the first position (described later) in the state that images can be formed. When an image signal of the first color outputted from an image reader which is different from the apparatus body 10 is inputted to the laser write system unit 22, a laser beam is generated by a semiconductor laser (not shown in the drawing) of the laser write system unit 22. This laser beam is rotationally scanned by a polygon mirror 221 which is rotated by a drive motor (not shown in the drawing) and irradiated onto the peripheral surface of the photosensitive belt 17, which is uniformly charged as specified beforehand by the charging unit 21, via a $f\theta$ lens 222, a cylindrical lens 224, and three mirrors 223 so as to form a bright line.

As to the secondary scanning direction, a belt index (not shown in the drawing) corresponding to a predetermined position of the photosensitive belt 17 is detected or a print instruction signal is received, and the primary scanning line whereon modulation of the semiconductor laser is started by an image signal on the basis of the above detection or instruction signal is determined. When scanning starts, as to the primary scanning direction, the laser beam is detected by an index sensor (not shown in the drawing), modulation of the semiconductor laser is started by the image signal of the first color, and the modulated laser beam scans on the surface of the photosensitive belt 17. Therefore, a latent image corresponding to the first color is formed on the surface, which is uniformly charged, of the photosensitive belt 17 by the primary scanning of the laser beam and by the secondary scanning by the movement of the photosensitive belt 17. This latent image is developed by the developing unit 23*a* of the developing means containing yellow (Y) toner corresponding to the first color and a yellow toner image is formed on the surface of the photosensitive belt 17. The photosensitive belt 17 passes under the cleaning blade 251 which is away from the surface of the photosensitive belt 17 with the yellow toner image held on the surface thereof and starts forming an image of the second color. The photosensitive belt 17 with the yellow toner image formed is uniformly charged by the charging unit 21 once again, an image signal of the second color is inputted to the write system unit 22, and data is written on the surface of the photosensitive belt 17 in the same way as with the image signal of the first color so as to form a latent image. The latent image is developed by the developing unit 23*b* containing magenta toner as a second color. This magenta toner image is formed under the condition that the yellow toner image, which is formed already, exists.

In the same way, a latent image is formed by an image signal of the third color and a cyan toner image is formed by the developing unit 23*c* containing cyan toner. Furthermore, a latent image is formed by an image signal of the fourth color, a black toner image is superimposed on the surface of the photosensitive belt 17 by the developing unit 23*d* containing black toner, and a color toner image is formed on the surface of the photosensitive belt 17.

A DC or AC bias voltage is applied to developing sleeves 231*a* to 231*d* of the developing units 23*a* to 23*d*, and reverse development (jumping development) is performed on the photosensitive belt 17 whose base is grounded in the non-contact state. For this non-contact development, either a 1-component or a 2-component developer may be used. When a 1-component developer is used, a toner hopper 35, which will be described later, is not required, and the apparatus can be made compact. However, the development method using a 2-component developer is superior in stability to the one using a 1-component developer and desirable for color reproduction.

The color toner image formed on the surface of the photosensitive belt 17 as mentioned above is fed by a paper feed roller 27 from a paper feed cassette 16 and transferred to a transfer material, which is synchronized with the color toner image, by timing rollers 28. The transfer unit 24 applies a high voltage output with a polarity reverse to that of the toner for transfer.

The transfer material, whereto the color toner image is transferred, is surely separated from the photosensitive belt 17 which changes the movement direction suddenly (a small curvature) around the drive roller 18 and moved up by a feed belt 29. The feed belt 29 is provided with a suction means 291 so as to move up the transfer material surely by sucking it. After the toner is melted and fixed by fixing rollers 30, the transfer material is ejected onto the top of the upper cover 11, which serves as a paper ejection tray, by paper ejection rollers 31.

The photosensitive belt 17, which finishes color toner image transfer to the transfer material, continues to move clockwise, and remaining toner is removed and cleaned by the cleaning means 25 wherein the cleaning blade 251 is pressed to the belt. Then, the cleaning blade 251 is separated from the photosensitive belt 17 once again and the apparatus enters a new image forming process.

Next, the life detection means will be described.

The life detection means of the process cartridge 15 of this embodiment checks the remaining quantity of replenishment toner contained in the toner hopper 35. The remaining quantities of toners are detected by remaining color toner sensors 40*a* to 40*d* installed in color toner hoppers 35*a* to 35*d* of yellow, magenta, cyan, and black and outputted to a life detection unit which will be described later. When the life detection unit detects that one of the remaining quantities is less than a preset quantity, it is judged that the process cartridge 15 has done its term of service. Since the remaining quantity (or use quantity) of toner correlates with the use lives of developers, the developing unit 23, and the process cartridge 15, this embodiment uses a life detection means that the remaining quantity of toner is measured as a life of the process cartridge 15. As remaining toner sensors 40*a* to 40*d*, conventional remaining toner sensors using optical detection methods such as piezoelectric elements, magnetic sensors, capacity detection sensors, weight detection sensors, or photocouplers can be used. A method that the remaining quantity of a 1-component toner is continuously detected with developing units and hoppers integrated as indicated in Japanese Patent Publication Open to Public Inspection No. 126568/1984 or a method that the remaining quantity of toner is intermittently detected at a plurality of levels using an intermittent electrode installed in each hopper as indicated in Japanese Patent Publication Open to Public Inspection No. 195673/1984 may be used. Any method which can detect the remaining quantity of toner may be used in the present invention.

Figure 14:
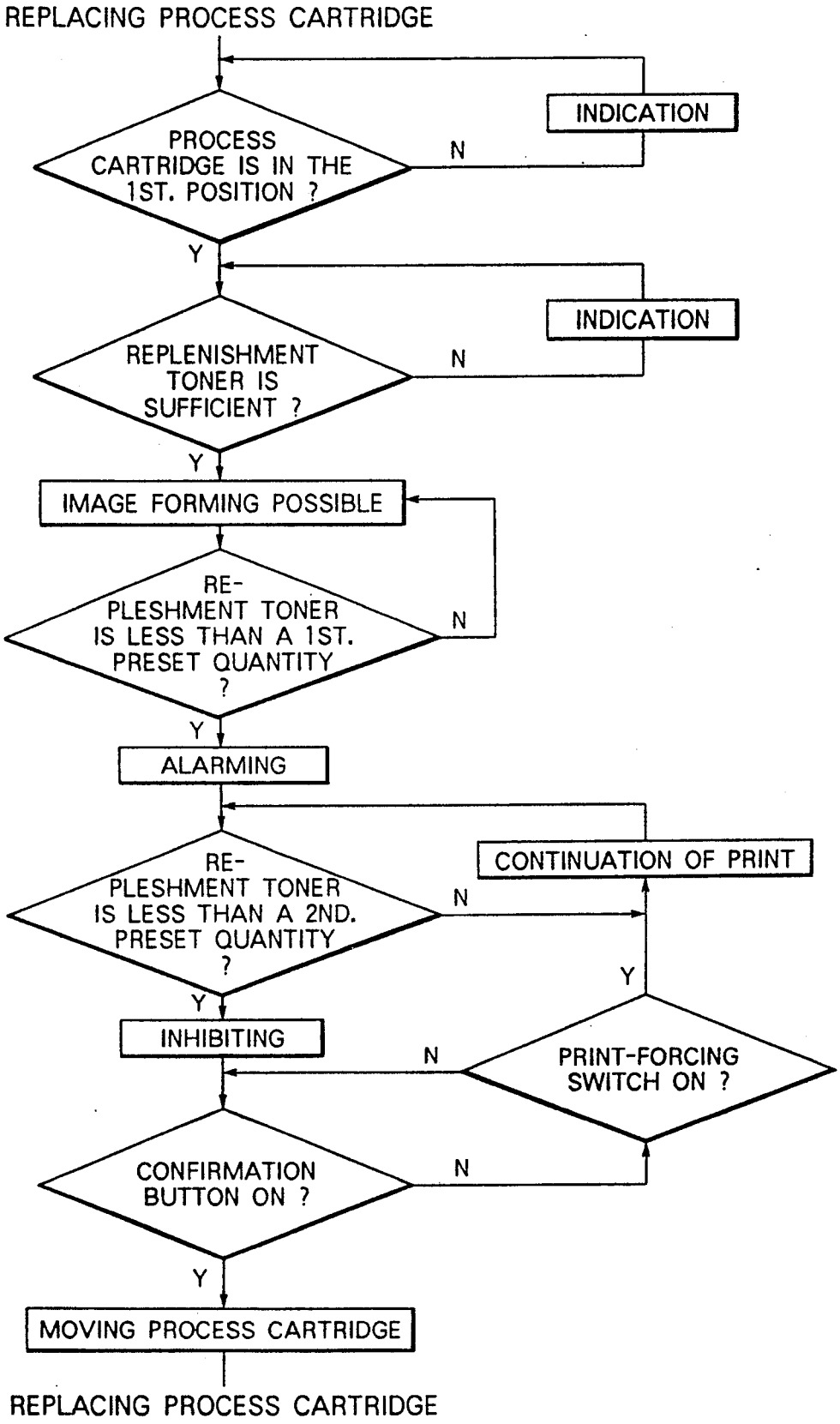
Figure 14:
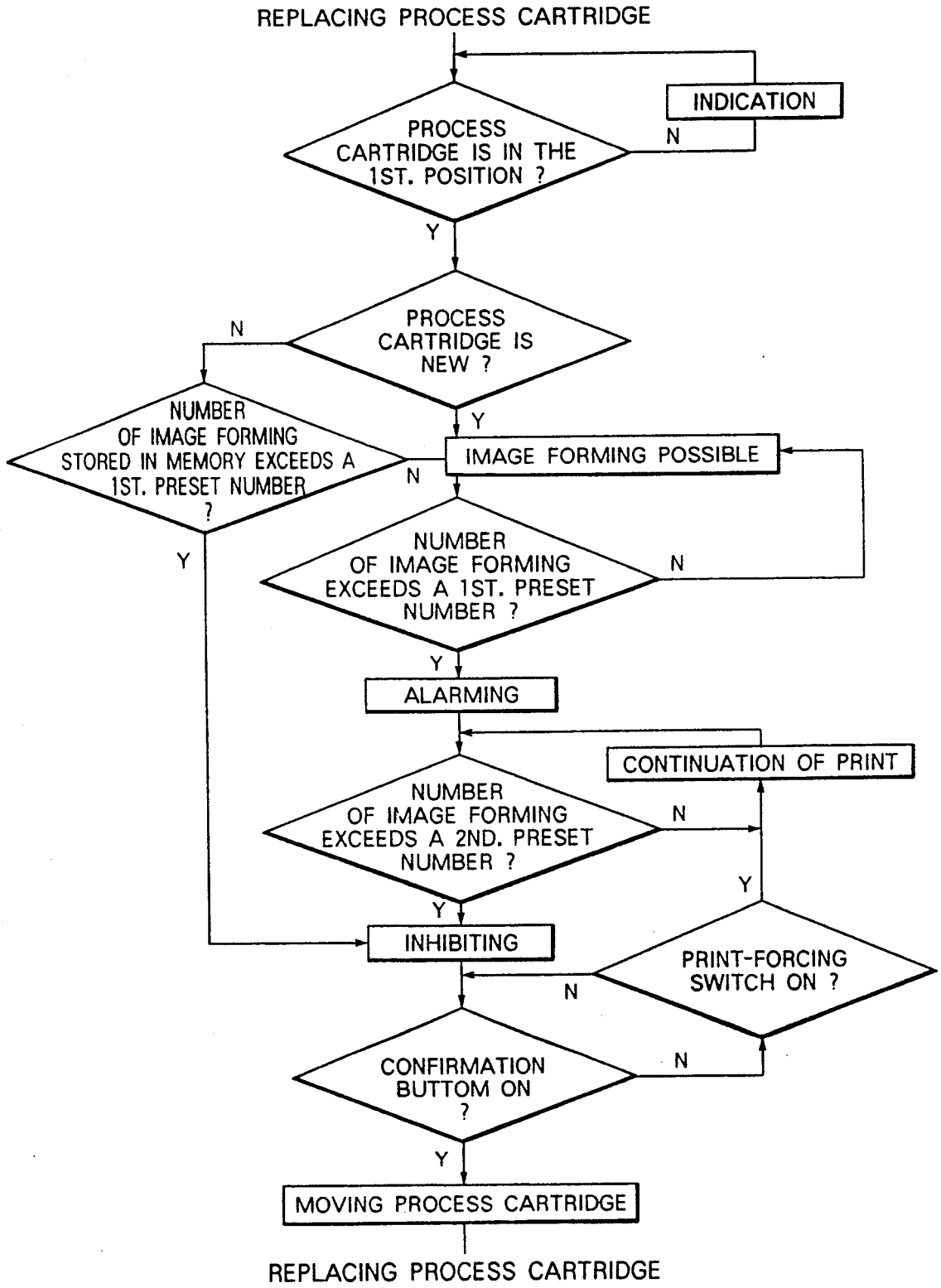
Figure 15:
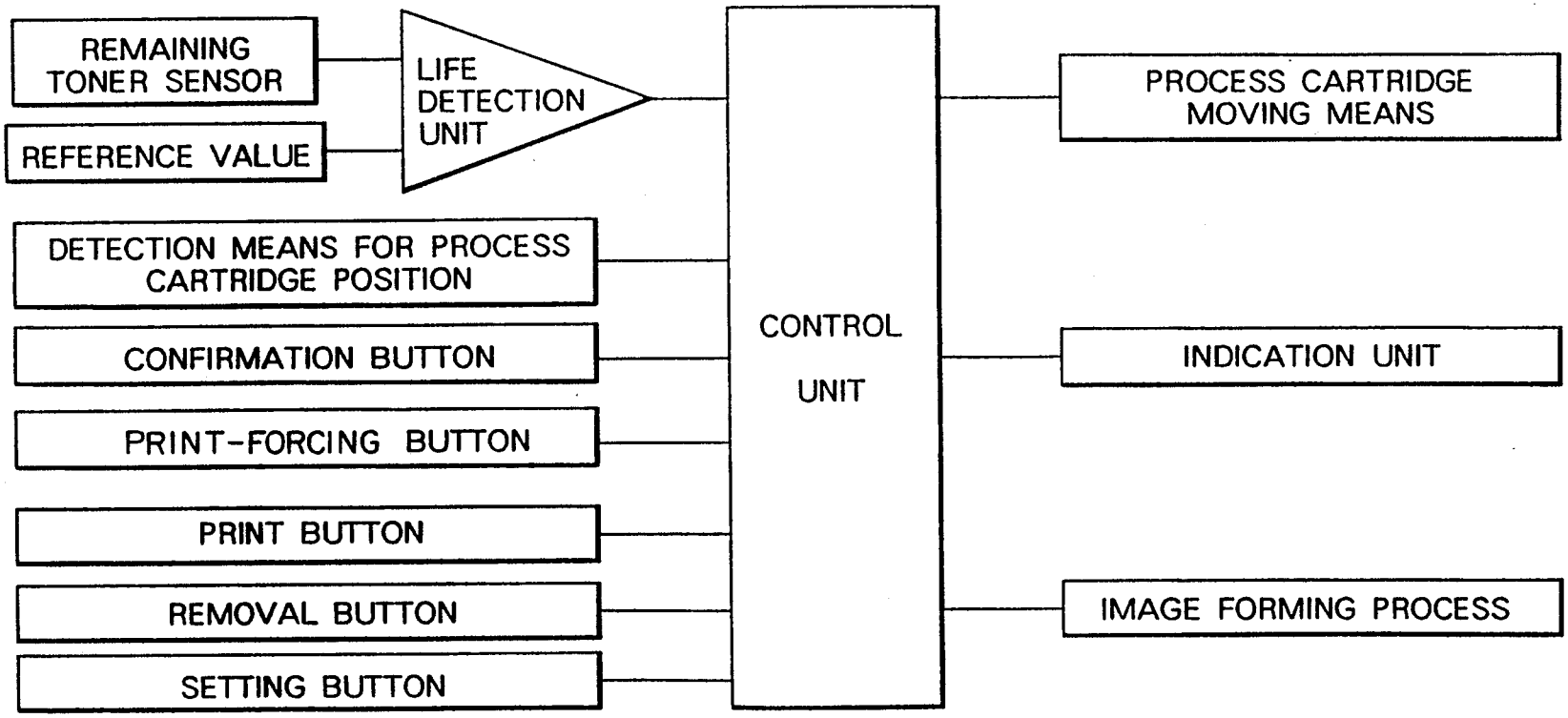
Figure 15:
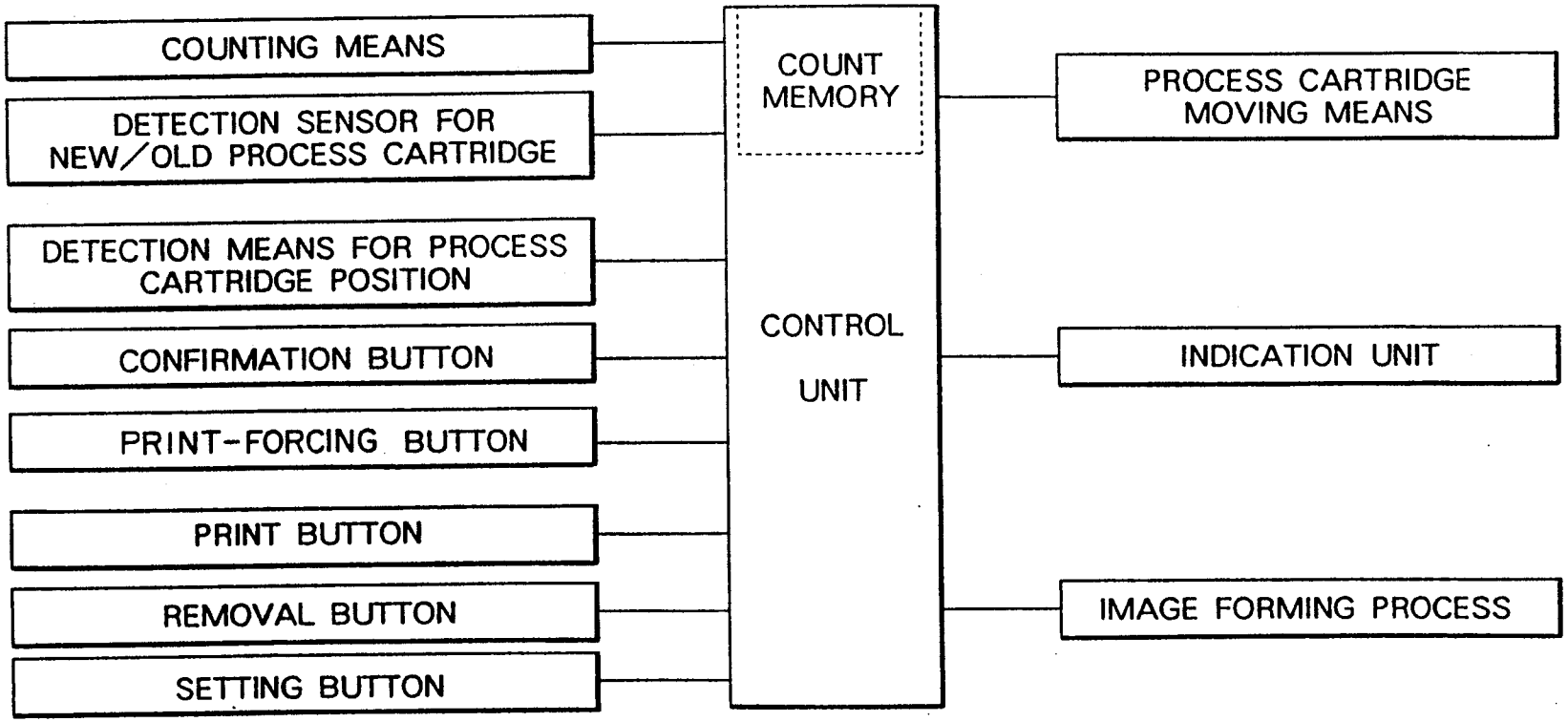

Next, the process from outputting a signal from the life detection means of the process cartridge 15 to outputting a process cartridge movement signal from the control unit will be described with reference to the flow chart shown in FIG. 14(*a*) and the control block diagram shown in FIG. 15(*a*).

When a new process cartridge 15 is inserted, whether or not the process cartridge 15 is at the first position (described later in detail) is confirmed. When the process cartridge 15 is not at the first position, a message of, for example, "Set Process Cartridge" is indicated on an indication unit installed on the operation panel 11. When the process cartridge 15 is at the first position, the apparatus goes to the next step.

The remaining toner sensors 40*a* to 40*d* decide whether the remaining quantity of each replenishment toner is sufficient. When the remaining quantity of a replenishment toner is not sufficient, a message of, for example, "Replenish Toner" is indicated on the indication unit. In a color image forming apparatus, replenishment toners of yellow, magenta, cyan, and black are required. The sufficient quantity is preferably a quantity of toner equivalent to the life of the process cartridge 15. When sufficient quantities of toners are provided, a print signal from a print button installed on the operation panel 11 can be received, that is, images can be formed.

When images are formed, the remaining quantities of replenishment toners in the toner hoppers 35*a* to 35*d* are detected continuously or intermittently by the remaining toner sensors 40*a* to 40*d*. Images can be formed repeatedly until the remaining quantity of each replenishment toner becomes less than a first preset quantity (for example, the remaining quantity of replenishment toner in each of the toner hoppers 35*a* to 35*d* is 20 mg, which is equivalent to printing of 20 sheets). When the life detection means decides that the remaining quantity of any toner is less than the first preset quantity, an alarm signal indicating that the life of the process cartridge 15 will expire soon is outputted to the control unit. Upon receipt of this alarm signal, the control unit indicates an alarm (for example, "Replace Process Cartridge") on the indication unit so as to notify the operator of it and request early replacement. As an alarm, an indication lamp (not shown in the drawing) may blink or a yellow indicator lamp may light.

When the control unit receives this alarm signal, images can be formed continuously until the remaining quantity of toner reaches a second preset quantity (for example, replenishment toners in the toner hoppers 35*a* to 35*d* are exhausted). When the life detection unit detects that the remaining quantity of toner detected by the remaining toner sensors 40*a* to 40*d* is less than the second preset quantity, a signal is outputted to the control unit. The control unit, which receives the signal, indicates inhibition of printing (for example, "Not Printed. Replace Process Cartridge.") on the indication unit so as to inform the operator that the life of the process cartridge has expired and does not receive an image forming signal; that is, the image forming operation cannot be performed. For this inhibition, an indicator lamp (not shown in the drawing) may light or a red indicator lamp may light.

The operator who is notified can press a confirmation button (not shown in the drawing) installed on the apparatus body 10 so as to confirm it. When the control unit receives a confirmation signal from the confirmation button, the control unit outputs a movement signal to a process cartridge movement means. When printing is required to be continued before replacing the process cartridge 15, it is desirable to allow the apparatus to enter the printable state forcibly by pressing a print-forcing button (not shown in the drawing) installed on the apparatus body. When at least one of the remaining quantities of toners detected by the remaining toner sensors 40*a* to 40*d* of the color toner hoppers 35*a* to 35*d* of the color image forming apparatus is less than the first preset quantity or the second preset quantity, the life detection unit outputs an alarm signal or a signal to the control unit. When a quantity of toner equivalent to the life of the process cartridge 15 cannot be stored due to a small capacity of the toner hopper 35, it is recommended to check the remaining quantity of toner after toner is replenished into the toner hopper 35 two or three times. In this embodiment, the remaining quantity of replenishment toner is detected as a life of the process cartridge 15 (life of the developing means 23 or developer). However, the quantity of used toner may be detected as a life. Furthermore, the total quantity of used color toners, which exceeds a preset quantity, may be detected as a life.

Next, another life detection means will be described. In this embodiment, the life of the process cartridge 15 is detected by a counting means for counting the number of images formed. The image forming count counted by the counting means is totalized by the control unit. When the totalized count reaches a value which is preset as a life of the process cartridge 15 (or photosensitive belt 17), it is decided that the life of the process cartridge has expired. The counting means counts passing of a transfer material, whereto a toner image formed on the photosensitive belt 17 is transferred, using a sensor for sheet (not shown in the drawing, the sensor may function as a jam detection sensor) installed behind the transfer means on the transfer material feed path. The sensor for sheet may be a transmission or reflection type photocoupler or a conventional sensor such as a non-contact lead switch or a contact microswitch. The counting means for counting image forming may calculate the number of images formed from the number of revolutions of the photosensitive belt 17 as indicated in Japanese Patent Publication Open to Public Inspection No. 163276/1982 or 152263/1983 or from the number of revolutions of the drive roller 18 for driving the photosensitive belt 17. Any method, which can count the images formed, can be applied to the present invention.

Next, the process from mounting the process cartridge 15 to outputting a process cartridge movement signal by the control unit will be described with reference to the flow chart shown in FIG. 14(*b*) and the control block diagram shown in FIG. 15(*b*).

When a new process cartridge 15 is inserted, whether or not the process cartridge 15 is at the first position (described later in detail) is confirmed. When the process cartridge 15 is not at the first position, a message of, for example, "Set Process Cartridge" is indicated on an indication unit installed on the operation panel 11. When the process cartridge 15 is at the first position, the apparatus goes to the next step.

Whether the process cartridge 15 is new or old is detected by a detection sensor for new/old process cartridge when the process cartridge 15 is being inserted (described later). When the process cartridge 15 is new, the count memory of the control unit is reset and a print signal from a print button installed on the operation panel 11 can be received; that is, images can be formed. When the process cartridge 15 is not new, it is decided whether the count stored in the count memory of the control unit is more than the first preset count (or the second preset count, described later). When the stored count is less than the preset count, the count memory of the control unit is left unchanged and images can be formed. When the stored count is more than the preset count, an inhibition signal, which will be described later, is outputted.

When an image is formed, the image forming count is counted by the above counting means and added to the count in the count memory. Images can be formed repeatedly until the totalized count exceeds the first preset count (for example, an image forming count of 29800). When the totalized count exceeds the first preset count, the control unit outputs an alarm signal indicating that the life of the process cartridge 15 will expire soon. The indication unit indicates an alarm (for example, "Replace Process Cartridge") so as to notify the operator and request early replacement. As an alarm, an indication lamp (not shown in the drawing) may blink or a yellow indicator lamp may light.

When the control unit receives this alarm signal, images can be formed continuously until the totalized count reaches the second count (for example, an image forming count of 30000) which is preset as a life of the process cartridge 15. In this case, it is desirable to indicate the difference between the second preset count and the totalized count on the indication unit when an image is formed. By doing this, the operator can prepare for replacement of the process cartridge 15 before the image forming count reaches the life of the process cartridge 15 or replace the process cartridge 15 before the life expires in the case of multiple image forming. When the totalized count reaches the second preset count, the control unit outputs a signal. The subsequent process is the same as that of the previous embodiment.

In this embodiment, when the control unit outputs a signal and then the operator presses the confirmation button, a movement signal is outputted to the process cartridge 15. However, this confirmation button may not be installed because the control unit can output the movement signal simultaneously with the life signal.

Next, the detection sensor for deciding whether the process cartridge 15, which is mounted to the apparatus body 10, is new or old will be described briefly.

It is desirable that the detection sensor for a new/old process cartridge decides whether the process cartridge 15 is new or old by a boss which is mounted to the process cartridge 15 so as to be detected when the process cartridge 15 is mounted to the apparatus body 10 and folded when printing starts. It is much more desirable to use a counter zero return starting means indicated in Japanese Patent Examined Publication No. 8295/1990 by the inventor of this invention as a detector sensor for new/old process cartridge. A method that a chemical change is identified by an optical detection means as indicated in Japanese Patent Publication Open to Public Inspection No. 198879/1987 may be used. When the counting means is installed in the process cartridge 15, no detection sensor for a new/old process cartridge is particularly required.

Figure 16:
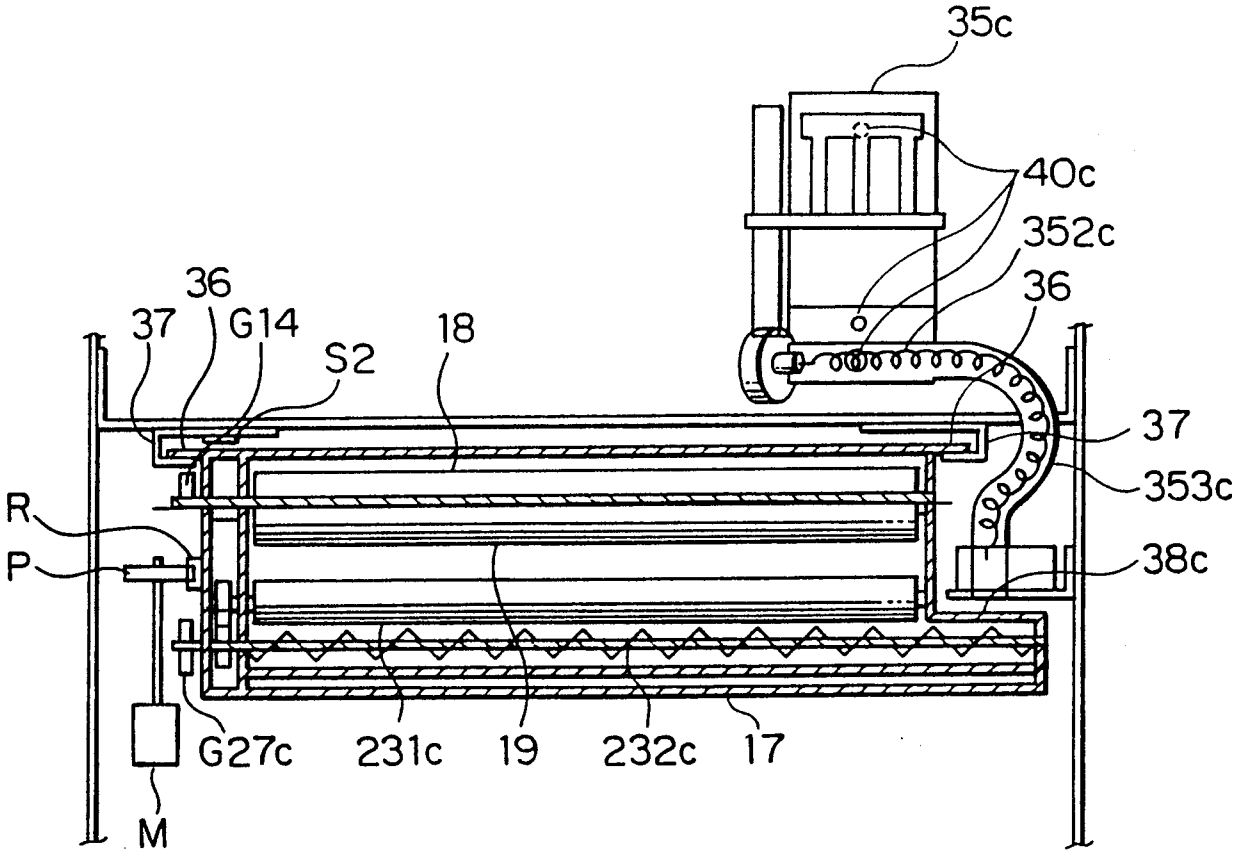
FIG. 16 is a view in the section AA shown in FIG. 13.

Next, the process cartridge movement according to the life detection means for the process cartridge 15 will be described with reference to FIG. 16, which is a view of the section AA shown in FIG. 13, and FIG. 17 which shows the movement of the process cartridge 15 schematically.

The process cartridge 15 comprises a protrusion member 36 for movement and a rack R which are mounted on the side thereof, a drive gear G14 for image forming means, developing unit drive gears G27*a* to G27*d*, and a waste toner screw drive gear G37.

In a chamber where the process cartridge of the apparatus body 10 is mounted, a guide member 37 for hanging the process cartridge 15, a gear G13, gears G26*a* to G26*d*, and a gear G36 are installed. A motor M for moving the process cartridge and a pinion P which can be engaged with the rack R are also installed.

Figure 17:
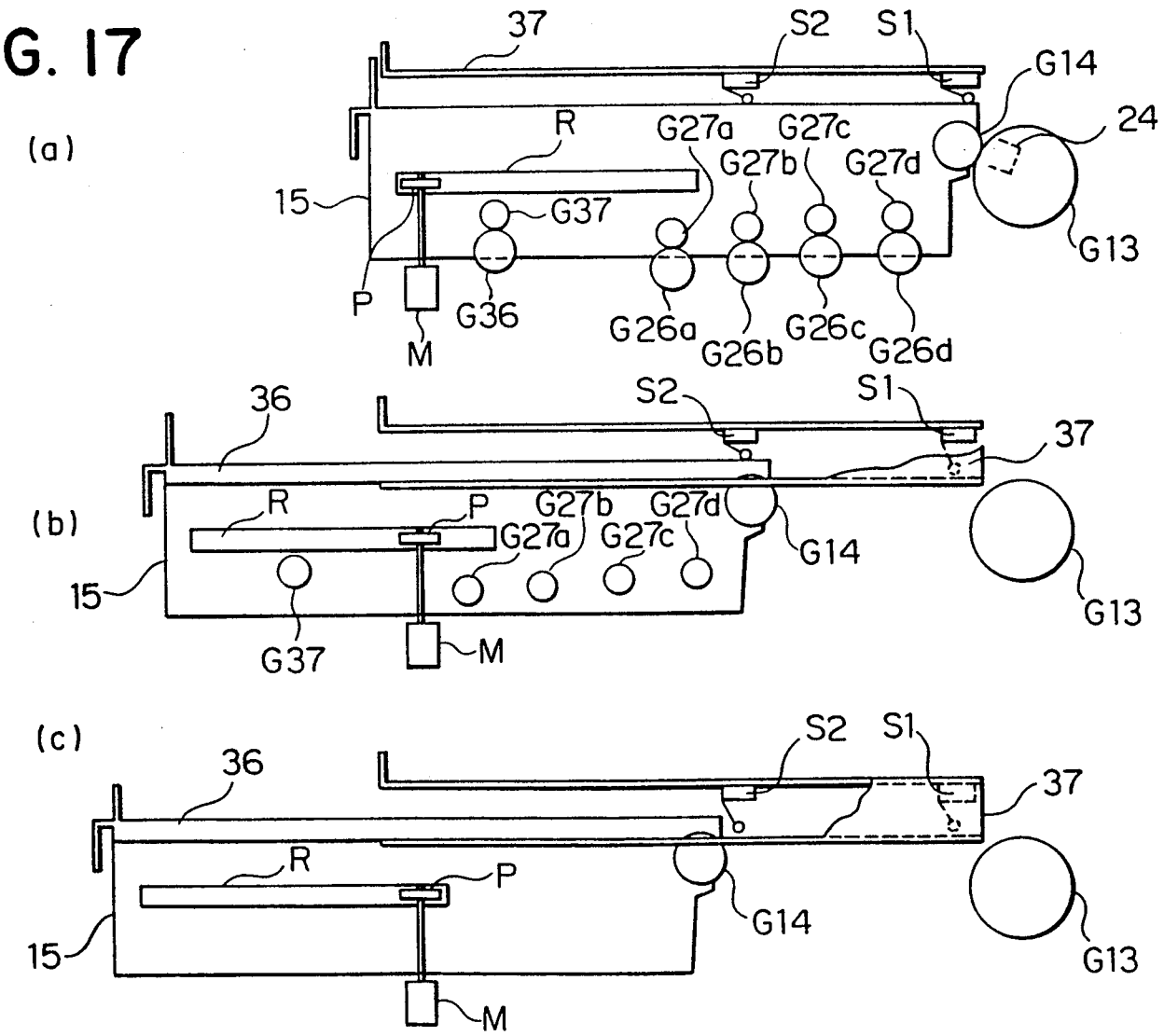
FIG. 17 is a schematic view showing the movement of the process cartridge schematically.

During image forming, the process cartridge 15 is at the first position (described later) as shown in FIG. 17(*a*) in the state that images can be formed most suitably.

When the life of the process cartridge is detected by the life detection means as mentioned above and a life signal is outputted to the control unit, the control unit outputs a process cartridge movement signal to the process cartridge movement means.

Or, when the totalized count exceeds the second preset count as mentioned above, the control unit outputs a life signal and then a process cartridge 15 movement signal to the process cartridge movement means.

The control unit allows the motor M for driving the process cartridge movement means installed in the apparatus body 10 to rotate, the pinion P mounted to the shaft of the motor to rotate, and the process cartridge 15 to move to the left or to the second position as shown in FIG. 17(*b*) along the guide member 37 installed in the apparatus body.

When the process cartridge 15 moves as shown in FIG. 17(*c*), a second microswitch S2 for detecting the second position detects that the process cartridge 15 moves to the second position and sends a signal indicating it to the control unit. Upon receipt of the signal, the control unit stops the rotation of the motor M so as to stop the moving process cartridge 15.

Figure 18:
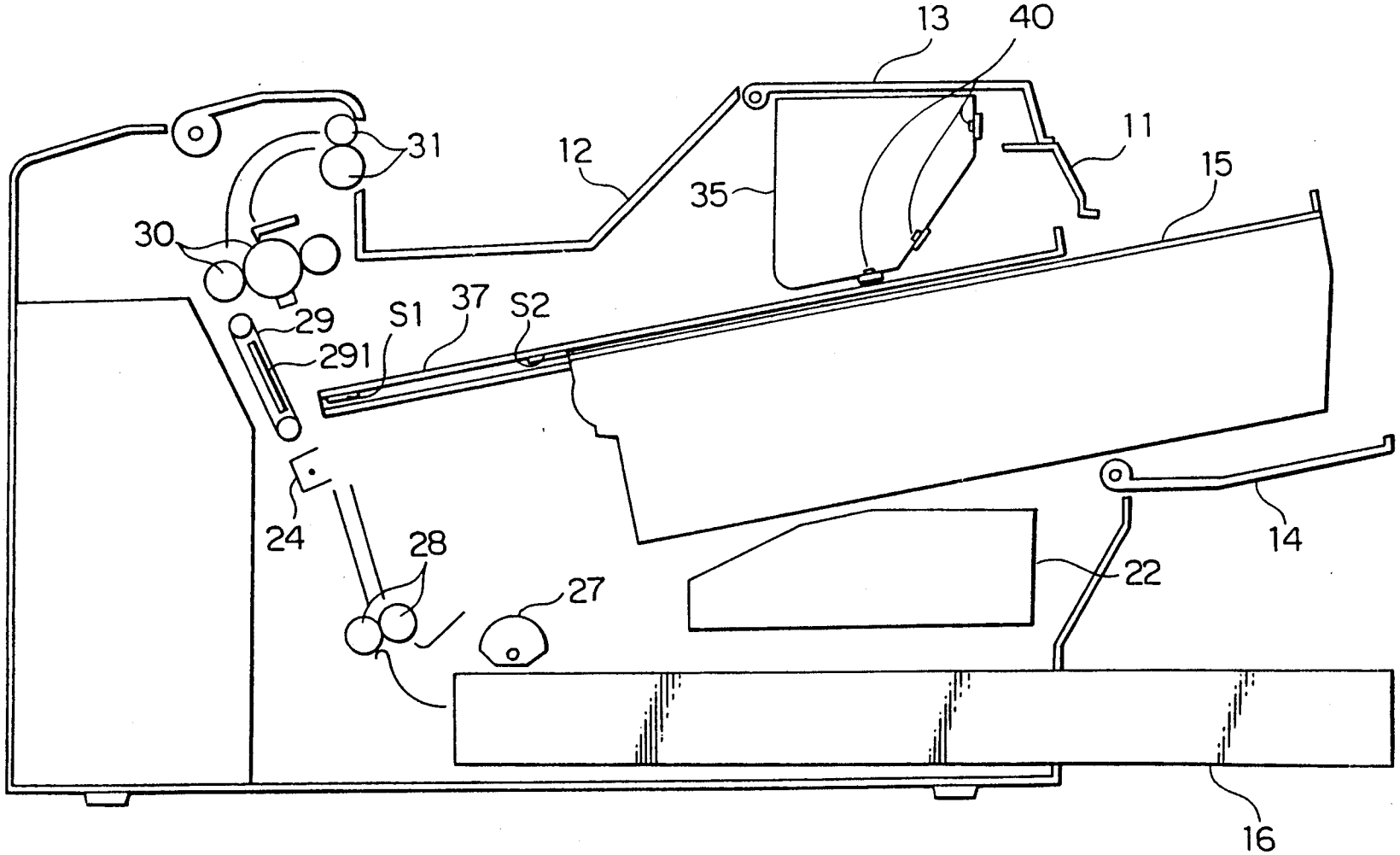
FIG. 18 is a main sectional view of a color printer on the left side when the process cartridge is at the second position.

When the life of the process cartridge expires, the process cartridge 15 automatically moves from the first position to the second position by the process cartridge movement means which receives the process cartridge movement signal from the control unit (see FIG. 18). The process cartridge 15 can be mounted or removed at the second position. The process cartridge 15 can be removed from the apparatus body 10 by slightly pulling it out from the second position for replacement. A front cover 14 is structured so as not to disturb movement of the process cartridge 15 (described later).

In the case of replacement, a new process cartridge 15 is inserted into the apparatus body 10 by sliding the bosses 36 mounted on both sides of the process cartridge 15 along the guide member 37 installed in the process cartridge storage chamber up to the second position so as to allow the rack R to be engaged with the pinion P (FIG. 17(*c*)).

When the process cartridge 15 is inserted still more so as to move the process cartridge 15 from the second position to the first position where images can be formed, the control unit sends a movement signal to the motor M, rotates the motor M reversely so as to move the process cartridge 15 from the second position to the first position, and moves the process cartridge 15 to the first position along the guide member 37 (FIG. 17(*b*)).

When the process cartridge 15 moves still more, a first microswitch S1 for detecting the first position detects that the process cartridge 15 moves to the first position as shown in FIG. 17(*a*) and sends a signal indicating it to the control unit. Upon receipt of the signal, the control unit stops the motor M so as to stop the process cartridge 15 at the first position. The process cartridge 15 is stopped at the first position and the apparatus is ready for forming images. In this case, to toner replenishment ports 38*a* to 38*d* of developing units 23*a* to 23*d* in the process cartridge 15, toner feed tubes 353*a* to 353*d* of yellow, magenta, cyan, and black of the corresponding toner hoppers 35*a* to 35*d* are automatically connected and the apparatus is ready for toner replenishment.

Since the process cartridge 15 can be set at the first position by a simple operation, the operational difficulties can be much reduced and the process cartridge 15 can be automatically set at a most suitable position.

The first and second microswitches S1 and S2 are detection means for detecting the position of the process cartridge 15. The drive gear G14 for driving the drive roller 18 installed in the process cartridge 15, the developing unit drive gears G27*a* to G27*d* for driving the developing units 23, and the waste toner screw drive gear G37 for driving the waste toner screw 261 are engaged with the gears G13, G26*a* to G26*d*, and G36 which are mounted to the apparatus body 10 so as to transfer driving force to the above gears, and the drive roller 18 is at a desired distance from the transfer unit 24. The first or second microswitch S1 or S2 detects the first position where images can be formed or the second position which is away from the transfer unit 24 compared with the first position or away from the first position in the direction opposite to the insertion direction of the process cartridge 15, and outputs a position signal to the control unit. It is recommended to set the second position so that the center of gravity of the process cartridge 15 is within the apparatus 10 so as to keep the engagement condition of the rack R and the pinion P satisfactory (at a distance of about $\frac{1}{3}$ to $\frac{1}{2}$ of the length of the process cartridge 15 from the first position). As position detection sensors for detecting the first and second positions, various existing sensors using photoelectric switches or magnetic switches other than microswitches may be used. Furthermore, the first and second microswitches S1 and S2 may be mounted on the apparatus body 10 if they can detect the first and second positions instead of the guide member 37. In this embodiment, the drive motor M for moving the process cartridge is an exclusive motor. However, it is needless to say that the image forming process drive motor may be used for that purpose. There are no restrictions on the bosses 36 for moving the process cartridge 15, the guide member 37, the rack R, and the pinion P used in this embodiment. For example, the process cartridge 15 may be placed on a tray which can move between the first and second positions.

The process cartridge 15 may be moved by pressing a removal button installed on the operation panel 11, other than when the life of the process cartridge 15 expires. When the removal button on the operation panel 11 is pressed, a removal signal is inputted to the control unit. When in this case, a print signal from the print button of the operation unit and an image forming process signal such as a photosensitive belt drive signal, a fixing and paper ejection drive signal, or a paper feed drive signal indicating that image forming processes such as the photosensitive belt drive unit, the fixing and paper ejection unit, or the paper feed unit are in operation are not outputted, a process cartridge movement signal is outputted to the process cartridge movement means even when no life signal is inputted to the control unit and the process cartridge 15 can be moved from the first position to the second position as mentioned above. When a set button installed on the operation panel 11 is pressed differently from above so as to move the process cartridge 15 from the second position to the first position, the control unit sends a movement signal for moving the process cartridge 15 from the second position to the first position to the process cartridge movement means, moves the process cartridge 15 to the first position, and puts the image forming apparatus into the image forming state.

In the case of movement of the process cartridge 15, it is possible that the upper cover 12 and the front cover 14, which are forced by springs, are stopped by solenoid valves, signals are outputted to the solenoid valves so as to release the stopping when the control unit outputs a signal for moving the process cartridge 15, and the upper cover 12 and the front cover 14 are released by the recovery force of the springs. When motors and gears are used for release, it is possible that not only the upper cover 12 and the front cover 14 are released when the process cartridge 15 starts movement from the first position to the second position but also when the process cartridge 15 moves from the second position to the first position, the upper cover 12 and the front cover 14 are automatically closed when the first microswitch S1 detects that the process cartridge 15 moves to the first position.

When the process cartridge 15 is mounted on the apparatus body 10, it is desirable that whether the process cartridge 15 is new or old can be identified. For example, new or old may be identified by a boss which is mounted to the process cartridge 15 so as to be detected when the process cartridge 15 is mounted on the apparatus body 10 and folded when printing starts. Or, new or old may be identified by detecting a chemical change as indicated in Japanese Patent Publication Open to Public Inspection No. 198879/1087.

In this embodiment, the remaining quantity of replenishment toner is detected as a life of the process cartridge 15. The quantity of collected waste toner in the toner collection box 26 may be detected as a life of the process cartridge 15. An actual method, which is similar to the remaining toner detection method, shown in this embodiment, using conventional remaining toner sensors using optical detection methods such as piezoelectric elements, magnetic sensors, capacity detection sensors, weight detection sensors, or photocouplers, can be applied. For example, an optical detection method using a photocoupler as indicated in Japanese Patent Publication Open to Public Inspection No. 207243/1988 may be applied. In the above cases, when the quantity of waste toner in the toner collection box 26 exceeds a preset quantity, the life of the process cartridge 15 expires. The number of revolutions of the developing sleeve 231 of the developing unit 23 may be detected as a life of the process cartridge 15.

This embodiment may be applied to a general monochromatic printer using the monochromatic process. The non-contact development method is used in this embodiment, though the contact method may be used instead of it. An image forming method that a color toner image is formed on the photosensitive belt and is transferred to a transfer material one color at a time can be used as an image forming process. However, a color image forming method that toner images are registrated on a transfer material on the photosensitive drum.

According to the present invention, an image forming apparatus can be realized, wherein operations such as replacement and inspection of process supplies of the image forming unit and replenishment of developers are performed at appropriate times, troubles such as jamming of a transfer material can be cleared immediately, easily, and quickly, and as a result, high quality images can be copied always under satisfactory inspection and maintenance.

As mentioned above, the present invention provides an image forming apparatus wherein a process cartridge is moved from a position where images can be formed by detecting the life of the process cartridge by a life detection means and the process cartridge can be set at a most suitable position.

As a result, in the image forming apparatus of the present invention, the process cartridge automatically moves by pressing a confirmation button by the operator and the process cartridge at the second position can be replaced by slightly pulling it out. Since the life detection means detects the life of the process cartridge and moves the process cartridge to the second position, the operator can replace the process cartridge easily and simply without hesitation and great force. Since the process cartridge moves mechanically, the process cartridge can be kept away from unnecessary vibration and replaced without scattering developers so as to improve maintainability. Since the operator is warned before the life of the process cartridge expires, the process cartridge can be replaced steadily in the case of multi-image forming without printing in a low density or badly-balanced in color. Furthermore, since the life detection means decides that the life of the process cartridge expires when the quantity of at least one of the color toner hoppers becomes below a preset quantity, images badly-balanced in color will not be formed in the case of a color image forming apparatus; that is, satisfactory images well-balanced in color can be obtained always.

When this image forming apparatus is a color printer, it is structured so that all operations such as installation or removal of the process cartridge or cassette, jam clearing, and toner replenishment can be performed via the front of the main unit so as to realize the operability and maintainability in the same way as the one-directional operability in a monochromatic printer.

What is claimed is:

1. An image forming apparatus comprising:

(a) a process cartridge having an image carrying member for forming a latent image integrated with at least one of means for developing the latent image and means for cleaning a residual developer on said image carrying member, said process cartridge being detachably mountable to said apparatus;

(b) means for moving said process cartridge from a first position in which image forming can be conducted to a second position located in the direction opposite to an insertion direction of said process cartridge;

(c) means for detecting the expiration of an operation life of said process cartridge and for outputting a signal; and (d) means for controlling said moving means, based on the signal output from said expiration detecting means.

2. The apparatus of claim 1, wherein the expiration of the operation life of said process cartridge is detected by the quantity of the developer supplied to said developing means.

3. The apparatus of claim 1, wherein there are provided a plurality of developing means in which a plurality of developers of different colors are used, and wherein the expiration of the operation life of said process cartridge is detected one of the quantity of said plurality of developers of different colors consumed.

4. The apparatus of claim 1, further comprising means for collecting the developer removed by said cleaning means, wherein the expiration of the operation life of said process cartridge is detected by the quantity of developer stored in said developer collecting means.

5. The apparatus of claim 1, further comprising means for counting the number of image forming operations of said process cartridge, wherein said control means controls said moving means to move said process cartridge when the number of image forming operations reaches a predetermined number.

6. The apparatus of claim 5, further comprising means for indicating that the number of image forming operations reaches a prescribed number less than the predetermined number.

7. The apparatus of claim 1, wherein said process cartridge is further capable of taking a third position at which jammed recording sheets can be cleared.

8. An image forming apparatus comprising:

(a) an image carrying member on which a latent image is formed;

(b) a process cartridge in which are integrally provided means for developing the latent image and means for replenishing developer to said developing means, said process cartridge being detachably mountable to said apparatus and being capable of taking a first position in which image forming can be conducted, a second position in which developer can be replenished, and a third position in which said process cartridge can be either detached or mounted;

(c) means for detecting depletion of the developer; and (d) said process cartridge being moved from the first position to the second position when said detecting means generates a depletion signal.

9. The apparatus of claim 8, wherein jammed recording sheets are clearable when said process cartridge is at the third position.

10. An image forming apparatus comprising:

(a) a belt type image carrying member stretched around two shafts, on which a latent image is formed;

(b) a plurality of developing means mounted along the periphery of said belt type image carrying member, for developing the latent image;

(c) a plurality of means for replenishing developer to each of said plurality of developing means;

(d) a process cartridge including said belt type image carrying member, said plurality of developing means and said plurality of replenishing means, said process cartridge being detachably mountable to said apparatus and being capable of taking a first position in which image forming can be conducted, a second position in which developer can be replenished, and a third position in which the process cartridge can be either detached or mounted;

(e) means for detecting depletion of the developer; and (f) said process cartridge being moved from the first position to the second position when said detecting means generates a depletion signal, in which either replenishment of developer or replacement of a container supplying developer to one of said plurality of developer replenishing means can be conducted.

11. The apparatus of claim 10, wherein jammed recording sheets are clearable when said process cartridge is at the third position.

* * * * *